US009796207B2

(12) United States Patent
Kawasaki

(10) Patent No.: US 9,796,207 B2
(45) Date of Patent: Oct. 24, 2017

(54) WRITING INSTRUMENT

(71) Applicant: V SPARK Co., Ltd., Saitama-shi, Saitama (JP)

(72) Inventor: Masayuki Kawasaki, Soka (JP)

(73) Assignee: V SPARK CO., LTD., Saitama-Shi, Saitama (JP)

( * ) Notice: Subject to any disclaimer, the term of this patent is extended or adjusted under 35 U.S.C. 154(b) by 242 days.

(21) Appl. No.: 14/405,555

(22) PCT Filed: Jun. 4, 2013

(86) PCT No.: PCT/JP2013/065469
§ 371 (c)(1),
(2) Date: Dec. 4, 2014

(87) PCT Pub. No.: WO2013/183633
PCT Pub. Date: Dec. 12, 2013

(65) Prior Publication Data

US 2015/0151565 A1 Jun. 4, 2015

(30) Foreign Application Priority Data

Jun. 4, 2012 (JP) ..... 2012-126888

(51) Int. Cl.
*B43K 5/00* (2006.01)
*B43K 5/18* (2006.01)
(Continued)

(52) U.S. Cl.
CPC ..... *B43K 27/08* (2013.01); *B43K 1/12* (2013.01); *B43K 8/003* (2013.01); *B43K 8/02* (2013.01);
(Continued)

(58) Field of Classification Search
CPC ..... B43K 27/08; B43K 1/12; B43K 8/003; B43K 8/02; B43K 8/03; B43K 8/04; B43K 15/00
See application file for complete search history.

(56) References Cited

U.S. PATENT DOCUMENTS 1,130,944 A 3/1915 Ullrich
2,130,978 A 9/1938 White
(Continued)

FOREIGN PATENT DOCUMENTS

CN 2415939 Y 1/2001
CN 201362062 Y 12/2009
(Continued)

OTHER PUBLICATIONS

Chinese Ottice Action issued in Appln. No. 201380029626.9 dated Dec. 3, 2015 (8 pages).
(Continued)

*Primary Examiner* — Allana Lewin Bidder
*Assistant Examiner* — Thomas M Abebe
(74) *Attorney, Agent, or Firm* — Flynn, Thiel, Boutell & Tanis, P.C.

(57) ABSTRACT

A writing instrument 2 includes a pen tip mechanism 20, an ink tank 40, an ink induction mechanism 50, and a regulator mechanism 60. The ink tank 40 includes first and second ink tanks 40A and 40B. The pen tip mechanism 20 includes first and second pen tips 20A and 20B. The ink induction mechanism 50 includes first and second induction cores 50A and 50B. A regulator flow path set around the first induction core 50A and the second induction core 50B is partitioned into first and second regulator flow paths by the regulator mechanism 60. The first and second regulator flow paths are temporary accommodation spaces of inks and circulation
(Continued)

spaces for sending air from the induction cores 50A and 50B to the ink tanks 40A and 40B.

39 Claims, 30 Drawing Sheets

(51) Int. Cl.

| | |
|---|---|
| ***B43K 8/02*** | (2006.01) |
| ***B43K 1/00*** | (2006.01) |
| ***B43K 8/04*** | (2006.01) |
| ***B43K 7/08*** | (2006.01) |
| ***B43K 27/08*** | (2006.01) |
| ***B43K 8/00*** | (2006.01) |
| ***B43K 8/03*** | (2006.01) |
| ***B43K 1/12*** | (2006.01) |
| ***B43K 15/00*** | (2006.01) |

(52) U.S. Cl.
CPC ..... *B43K 8/03* (2013.01); *B43K 8/04* (2013.01); *B43K 15/00* (2013.01); *Y10T 29/49826* (2015.01)

(56) References Cited

U.S. PATENT DOCUMENTS

| | | | | |
|---|---|---|---|---|
| 2,685,273 | A * | 8/1954 | Wing | B43K 5/18 401/188 R |
| 4,556,336 | A * | 12/1985 | Sano | B43K 5/18 401/199 |
| 5,899,619 | A | 5/1999 | O'Shei | |
| 5,971,643 | A | 10/1999 | Ahmed | |
| 8,096,725 | B2 * | 1/2012 | Bedhome | B43K 7/08 401/198 |
| 2001/0004430 | A1 * | 6/2001 | Mito | B43K 8/04 401/223 |
| 2001/0012468 | A1 * | 8/2001 | Furukawa | B43K 1/086 401/34 |
| 2003/0072600 | A1 * | 4/2003 | Furukawa | B43K 5/005 401/224 |
| 2003/0180084 | A1 * | 9/2003 | Firukawa | B43K 5/18 401/227 |
| 2005/0226675 | A1 | 10/2005 | Kwan et al. | |
| 2007/0251542 | A1 * | 11/2007 | Tajima | A45D 34/04 132/320 |
| 2015/0231916 | A1 * | 8/2015 | Tani | B43K 15/00 29/890.1 |
| 2016/0229218 | A1 * | 8/2016 | Hoshino | B43K 8/03 |

FOREIGN PATENT DOCUMENTS

| | | | |
|---|---|---|---|
| EP | 1 543 991 | A2 | 6/2005 |
| GB | 2 166 088 | A | 4/1986 |
| JP | 58-26983 | U | 2/1983 |
| JP | 1-115590 | U | 8/1989 |
| JP | 10-217671 | A | 8/1998 |
| JP | 2001-523600 | A | 11/2001 |
| JP | 2005-7740 | A | 1/2005 |
| JP | 2005-178050 | A | 7/2005 |
| JP | 2007-176110 | A | 7/2007 |
| WO | WO 01/15912 | A1 | 3/2001 |
| WO | WO 2009/126867 | A2 | 10/2009 |

OTHER PUBLICATIONS

Supplementary Partial European Search Report issued in Appln. No. 13799797.9 dated Apr. 15, 2015 (6 pages).
English translation of the International Search Report issued in PCT/JP2013/065469 dated Sep. 10, 2013 (2 pages).

* cited by examiner 62S, 62L } 62 67A, 67B } 67 68A, 68B } 68

68A } 68
68B

67A } 67
67B

WRITING INSTRUMENT

TECHNICAL FIELD

The present invention relates to a writing instrument.

BACKGROUND ART

There has been known a writing instrument having an ink tank, such as a fountain pen or a marking pen. For example, a writing instrument described in Japanese Patent Laid-Open No. 2007-176110 includes one pen tip, one ink tank that accommodates ink, and one core that induces the ink to the pen tip from the ink tank.

SUMMARY OF INVENTION

Technical Problem

Unfortunately, characters or lines written by a writing instrument are distinguished and written with a plurality of colors without being limited to a single color in many cases. However, only one ink tank is provided at the writing instrument described in Patent Literature 1. For this reason, whenever writing is performed with different colors, it is necessary to replace the writing instrument with another one or to exchange the ink tank. As mentioned above, when characters or lines are distinguished and written with different colors, a writer may have a troublesome operation.

In view of the forgoing, the present invention provides a writing instrument.

Solution to Problem

In order to solve the problem, the present invention provides a writing instrument including: an ink tank that accommodates ink; a pen tip mechanism that has a pen tip holding the ink discharged from the ink tank; an ink induction mechanism that is provided at a circulation path of the ink which connects the ink tank and the pen tip mechanism, and supplies the ink discharged from the ink tank to the pen tip; an ink induction housing that accommodates the ink induction mechanism; and a regulator mechanism that is provided around the ink induction mechanism to adjust a flow rate of the ink at the circulation path of the ink provided to come in contact with an inner surface of the ink induction housing. The ink tank includes a first ink tank that accommodates a first ink, and a second ink tank that accommodates a second ink different from the first ink. The pen tip mechanism includes a first pen tip to which the first ink is supplied, a second pen tip to which the second ink is supplied, and a pen-tip holding mechanism that holds the first pen tip and the second pen tip to be parallel to each other. The ink induction mechanism includes a first induction core that induces the first ink discharged from the first ink tank provided at the circulation path of the ink to the first pen tip, and a second induction core that induces the second ink discharged from the second ink tank provided at the circulation path of the ink to the second pen tip. The regulator mechanism includes first and second regulator flow paths that are respectively set around the first induction core and the second induction core, and a flow-path partitioning member that is disposed to partition a regulator flow path into the first regulator flow path and the second regulator flow path, and prevents the first and second inks from being mixed with each other in the first and second regulator flow paths. The first regulator flow path is a temporary accommodation space of the first ink and a space where air is circulated. The second regulator flow path is a temporary accommodation space of the second ink and a space where air is circulated.

The ink tank may have a double tube structure that includes a cylindrical large-diameter tube and a cylindrical small-diameter tube which has a diameter smaller than the large-diameter tube and is disposed inside the large-diameter tube, the first ink tank may be formed inside the small-diameter tube, and the second ink tank may be formed between the small-diameter tube and the large-diameter tube. The cylindrical small-diameter tube may be coaxially disposed an inside of the large-diameter tube.

An end part of the second ink tank close to the ink induction mechanism may protrude toward the ink induction mechanism than an end part of the first ink tank close to the ink induction mechanism. A second ink communicating hole that communicatively connects the second ink tank and the second induction core may be located close to the pen tip mechanism than a first ink-tank communicating hole that communicatively connects the first ink tank and the first induction core.

An end part of the ink induction mechanism close to the ink tank mechanism may be inserted into the small-diameter tube. The small-diameter tube and the large-diameter tube may be formed to be separated from each other. Alternatively, the writing instrument may further include a tube connecting member that connects the small-diameter tube and the large-diameter tube.

An end part of the first ink tank opposite to the pen tip mechanism may be farther from the pen tip mechanism than an end part of the second ink tank opposite to the pen tip mechanism. The ink tank may include an ink guide mechanism that guides the ink within the ink tank to the ink induction mechanism.

The ink guide mechanism may be any one of a small-diameter-tube outer groove that extends toward the ink induction mechanism formed on an outer peripheral surface of the small-diameter tube and a large-diameter-tube inner groove that extends toward the ink induction mechanism formed on an inner peripheral surface of the large-diameter tube.

The first induction core may be communicatively connected to the first ink tank through a part of the ink induction mechanism inserted into the small-diameter tube.

The writing instrument may further include a rear-end-surface opening space through which a rear end surface of the second induction core is opened. The rear-end-surface opening space may be communicatively connected to the second ink tank.

The second induction core may be communicatively connected to the second ink tank through a side hole of the ink induction mechanism.

Air may be circulated between the first regulator flow path and the first ink tank through a first vent hole which is formed at a part of the ink induction mechanism inserted into the small-diameter tube. Air may be circulated between the second regulator flow path and the second ink tank through a second vent hole formed in the regulator mechanism without passing through the ink induction mechanism. Air may be circulated between the second regulator flow path and the second ink tank through a second vent hole formed in the ink induction mechanism without passing through the ink induction mechanism.

The ink induction mechanism may include an induction-core accommodating part that accommodates the first induction core and the second induction core in first and second induction-core accommodating holes that independently formed to be parallel to each other, the first and second regulator flow paths are formed outside the induction-core accommodating part, and the flow-path partitioning member extends from an outside of the induction-core accommodating part to an inside of the outer housing to block the first regulator flow path from the second regulator flow path.

The ink induction mechanism may include a first exposing opening that exposes a side surface of the first induction core inserted into the first induction-core accommodating hole to the first regulator flow path, and a second exposing opening that exposes a side surface of the second induction core inserted into the second induction-core accommodating hole to the second regulator flow path.

The ink induction mechanism may include an induction-core accommodating part that accommodates the first induction core and the second induction core in first and second induction-core accommodating holes that are independently formed to be parallel to each other, and the first induction core may be latched to the induction-core accommodating part through thermal fusing.

An end part of the first induction core opposite to the pen tip mechanism may be located on a side opposite to the pen tip mechanism from the induction-core accommodating part.

The pen-tip holding mechanism may include a first pen-tip holding mechanism that holds a base part of the first pen tip, a second pen-tip holding mechanism that holds a base part of the second pen tip, and a pen-tip partitioning mechanism that is disposed between a front end part of the first pen tip and a front end part of the second pen tip. The pen-tip partitioning mechanism may include a flushing and retreating part that is flush with the first pen tip and the second pen tip or is retreated therefrom, and a protruding part that protrudes from the first pen tip and the second pen tip. The flushing and retreating part may be formed at a front part of the pen-tip partitioning mechanism. The protruding part may be formed at a side part of the pen-tip partitioning mechanism.

Any one of a front end of the first pen tip and a front end of the second pen tip may be bent such that the first pen tip comes in contact with the second pen tip.

There is provided a method of manufacturing a writing instrument that includes a first ink tank accommodating a first ink, a second ink tank accommodating a second ink, a first pen tip to which the first ink accommodated in the first ink tank is supplied, and a second pen tip to which the second ink accommodated in the second ink tank is supplied. The method includes a second-ink-tank forming step of forming the second ink tank between the first ink tank and accommodation means by using the accommodation means for accommodating the second ink in an accommodation space and inserting the first ink tank into the accommodation space.

The method may further include a second-ink supplying step of supplying the second ink to the accommodation space, the second-ink supplying step being performed before the second-ink-tank forming step. The method may further include a first-ink supplying step of supplying the first ink to the first tank, the first-ink supplying step being performed before the second-ink supplying step. The method may further include a first airtight step of sealing the first ink tank to which the first ink has been supplied, the first airtight step being performed before the second-ink supplying step.

Advantageous Effects of Invention

According to a writing instrument of the present invention, it is easy to distinguish and write characters or lines with different colors.

DESCRIPTION OF EMBODIMENTS

Hereinafter, embodiments of the present invention will be described with reference to the accompanying drawings.

Figure 1:
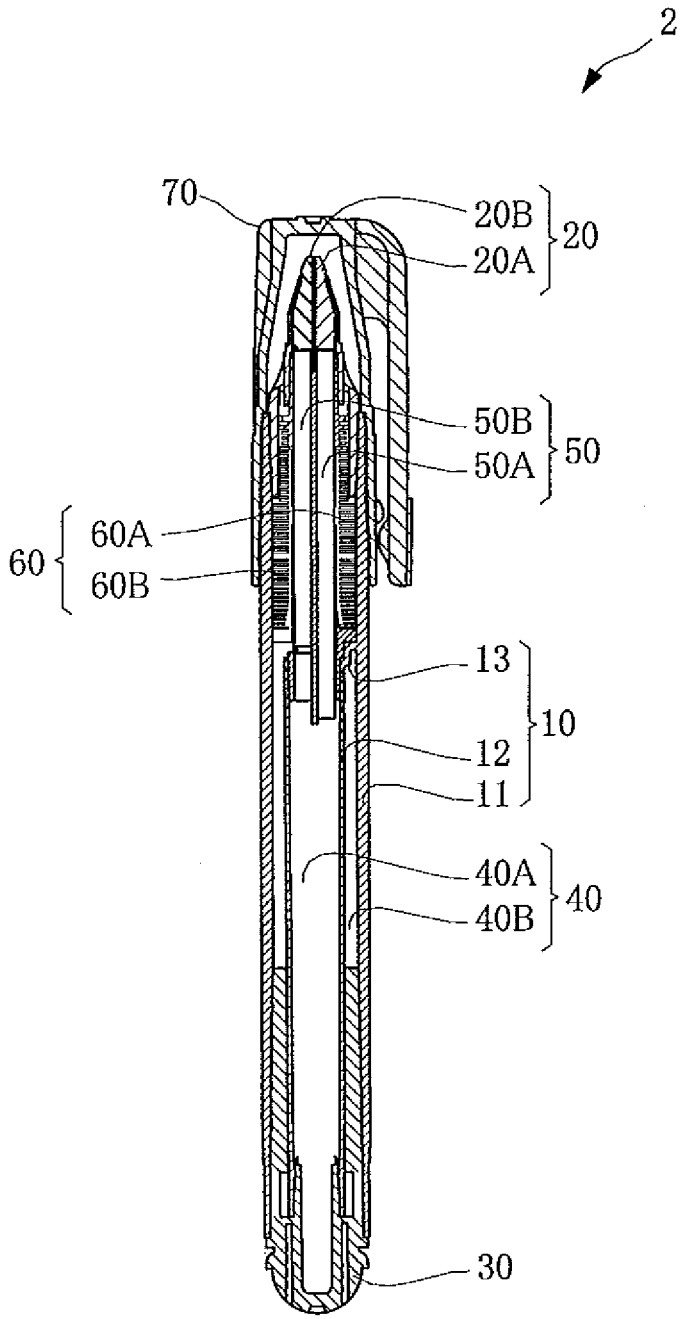
FIG. 1 is a cross-sectional view illustrating an outline of a first writing instrument.

As illustrated in FIG. 1, a writing instrument 2 elongates in a back and forth direction. The writing instrument includes a cylindrical accommodation tube 10, a pen tip mechanism 20 that is attached to a front end part of the accommodation tube 10, and a tail plug 30 that is attached to a rear end part of the accommodation tube 10. The accommodation tube 10 is made of synthetic resin, for example, PP (polypropylene), PE (polyethylene), PET (polyethylene-terephthalate), nylon, polyester, or acryl. The pen tip mechanism 20 is made of, for example, POM (acetal resin), PBT (polybutylene-terephthalate), PP, ABS resin, PC (polycarbonate), nylon, polyester, or acryl. The tail plug 30 is made of the same material as that of the accommodation tube 10.

Further, the writing instrument 2 includes an ink tank mechanism 40 that accommodates ink, and an ink induction mechanism 50 that induces the ink accommodated in the ink tank mechanism 40 to the pen tip mechanism 20.

The ink tank mechanism 40 is accommodated on a rear end side of an inside of the accommodation tube 10. The ink induction mechanism 50 is accommodated on a front side of the ink tank mechanism 40 within the accommodation tube 10. A front end of the ink tank mechanism 40 is connected to a rear end of the ink induction mechanism 50. Further, the pen tip mechanism 20 is connected to a front end of the ink induction mechanism 50 by attaching the pen tip mechanism 20 to the front end part of the accommodation tube 10. With such a configuration, the ink discharged from the ink tank mechanism 40 reaches the pen tip mechanism 20 via the ink induction mechanism 50.

In addition, the writing instrument 2 includes a regulator mechanism 60 formed around the ink induction mechanism 50. The regulator mechanism 60 is provided around the ink induction mechanism 50. The regulator mechanism 60 includes a regulator flow path that extends from the ink induction mechanism 50 to the ink tank mechanism 40. The regulator flow path allows air outside a writing part or ink within an ink tank to be circulated. By forming such a regulator flow path, even when a pressure within the ink tank is higher than a pressure outside the writing instrument, since the ink within the ink tank stays in the regulator flow path, a pressure balance between the outside of the writing instrument and the inside of the ink tank is maintained, so that the ink is not discharged from the pen tip mechanism 20. The regulator mechanism 60 is made of, for example, ABS resin.

Furthermore, the writing instrument 2 may include a cap 70 attached to a front end side of the accommodation tube 10 so as to cover the pen tip mechanism 20.

Next, the respective components will be described in detail.

Figure 2:
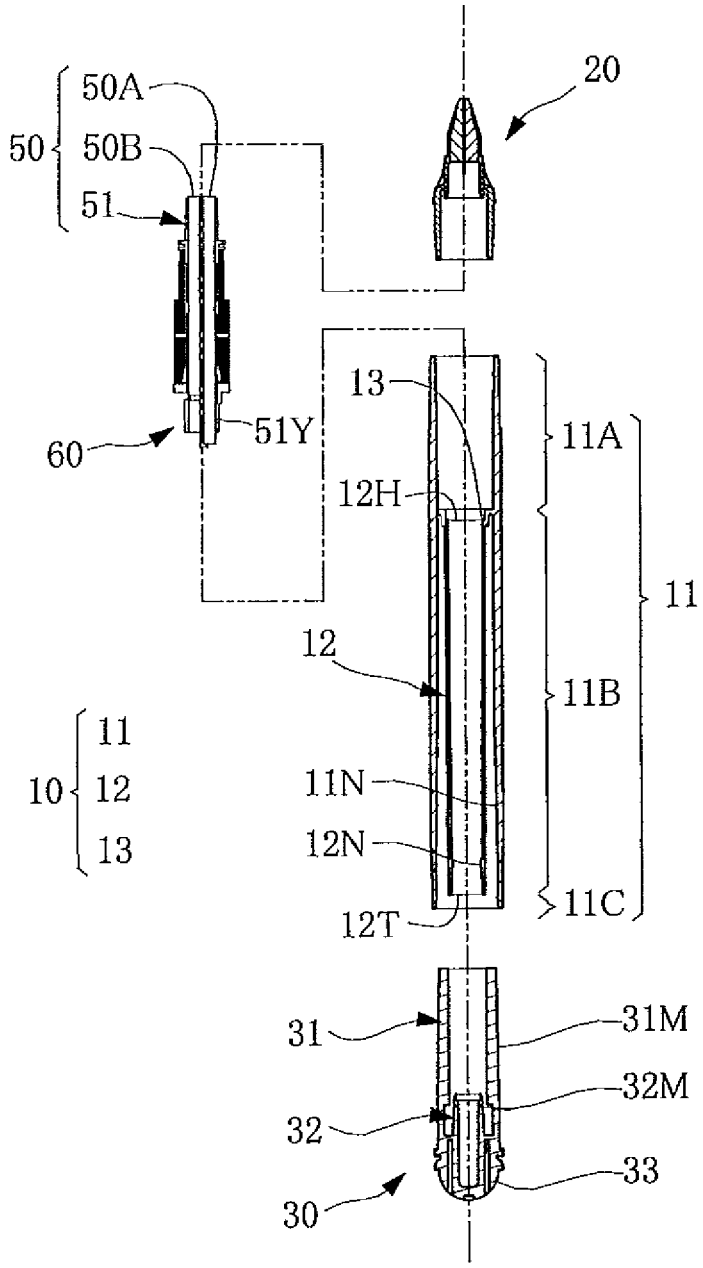
FIG. 2 is an exploded cross-sectional view illustrating the outline of the first writing instrument.

As illustrated in FIG. 2, the accommodation tube 10 includes a large-diameter tube part 11, a small-diameter tube part 12 having a diameter smaller than the large-diameter tube part 11, and a tube connecting part 13 that connects the large-diameter tube part 11 and the small-diameter tube part 12. The large-diameter tube part 11 includes an induction-mechanism accommodating part 11A that accommodates the ink induction mechanism 50 and the regulator mechanism 60, a small-diameter-tube accommodating part 11B that accommodates the small-diameter tube part 12, and a rear housing 11C that is fitted to the tail plug 30. The small-diameter tube part 12 is disposed inside the small-diameter-tube accommodating part 11B. Preferably, the small-diameter tube part 12 is disposed coaxially with the large-diameter tube part 11. An opening (hereinafter, referred to as a rear end opening) 12T on a rear end side of the small-diameter tube part 12 and an opening (hereinafter, referred to as a front end opening) 12H on a front end side of the small-diameter tube part 12 are opened to a hollow part of the large-diameter tube part 11.

Referring back to FIG. 1, the ink tank mechanism 40 includes a first ink tank 40A that accommodates a first ink, and a second ink tank 40B that accommodates a second ink. The second ink tank 40B is formed inside the small-diameter tube part 12, and the first ink tank 40A is formed between the small-diameter-tube accommodating part 11B and the small-diameter tube part 12. The first ink and the second ink have different colors from each other. The first ink and the second ink may have the same color as long as the first and second inks have different components (for example, one ink is an oil-based ink, and the other ink is a water-based ink).

Figure 3A:
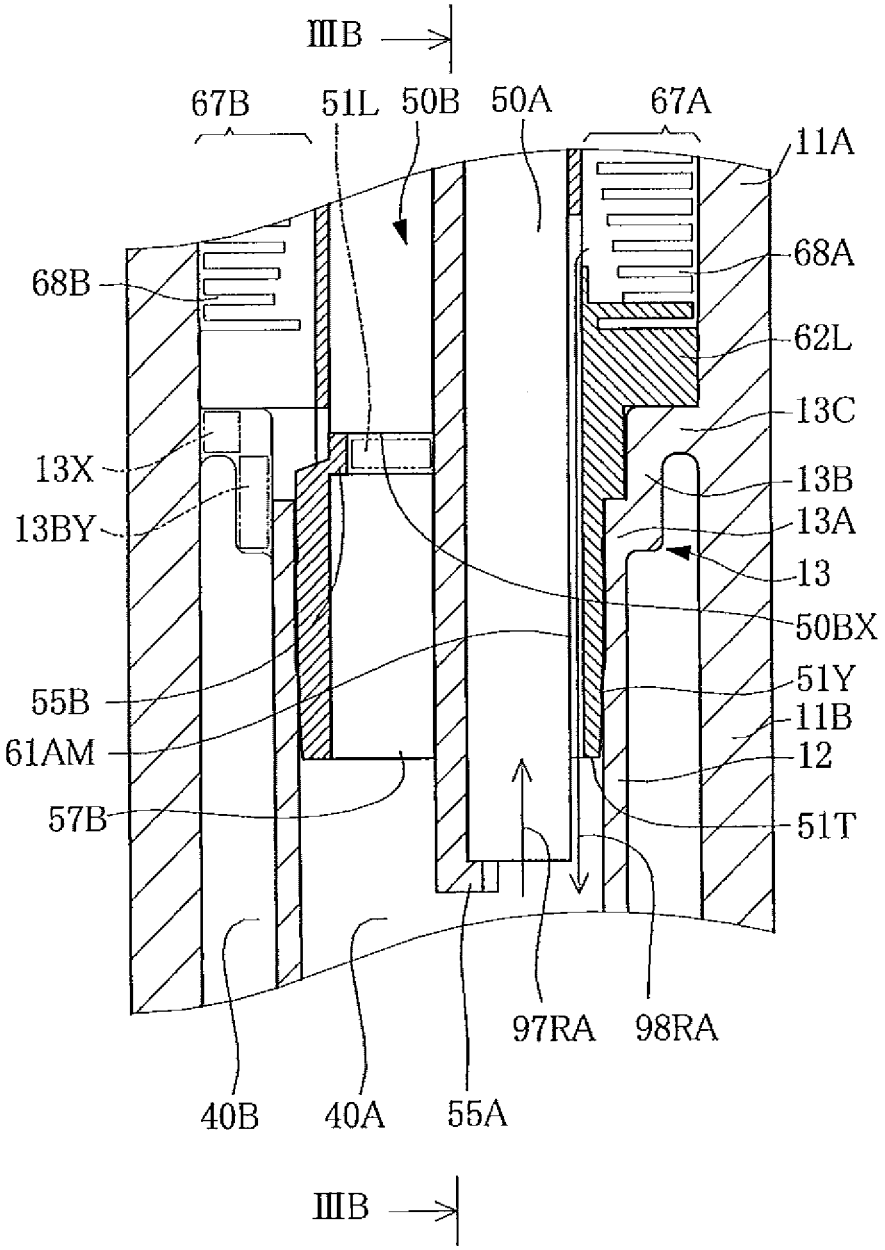
FIG. 3A is a cross-sectional view taken along line IIIA-IIIA which enlarges a part of a first ink tank mechanism that is fitted to a first ink induction mechanism and a first regulator mechanism.

As illustrated in FIG. 3A, the tube connecting part 13 includes a ring-shaped small-diameter protruding part 13A that protrudes toward an inner peripheral surface of the small-diameter-tube accommodating part 11B from an outer peripheral surface of a front end of the small-diameter tube part 12, a ring-shaped front protruding part 13B that extends toward the front side from an outer peripheral part of the small-diameter protruding part 13A, and a ring-shaped connecting part 13C that extends from an outer peripheral surface of the front protruding part 12B to an inner peripheral surface of the large-diameter tube part 11. For this reason, as an inner peripheral part of the tube connecting part 13 is close to a rear end side from a front end side, a diameter thereof is gradually reduced. The inner peripheral part of the tube connecting part 13 whose diameter is gradually reduced can be fitted to a rear end part of the ink induction mechanism 50 (see FIG. 2).

Referring again to FIG. 2, the tail plug 30 includes a large-diameter engaging tube 31 that engages with a rear end of the rear housing 11C, a small-diameter engaging tube 32 that engages with a rear end of the small-diameter tube part 12, and a plug main body 33 that connects the large-diameter engaging tube 31 and the small-diameter engaging tube 32. The large-diameter engaging tube 31 and the small-diameter engaging tube 32 are respectively provided so as to protrude toward the front side from a front end surface of the plug main body 33. The large-diameter engaging tube 31 is formed to surround the small-diameter engaging tube 32.

Accordingly, the large-diameter engaging tube 31 and the small-diameter engaging tube 32 constitute a double tube structure. A ring-shaped circumferential groove 32M is formed on an outer peripheral surface of a front end of the small-diameter engaging tube 32. The circumferential groove 32M can be latched to a projection 12N formed on an inner peripheral surface of the rear end side of the small-diameter tube part 12. A ring-shaped circumferential groove 31M is formed on an outer peripheral surface of a front end of the large-diameter engaging tube 31. The circumferential groove 31M can be latched to a projection 11N formed on the inner peripheral surface of the small-diameter-tube accommodating part 11B. When the tail plug 30 is inserted into the rear end of the accommodation tube 10, the large-diameter engaging tube 31 engages with a rear end side of the large-diameter tube part 11, and the small-diameter engaging tube 32 engages with the rear end side of the small-diameter tube part 12. With such a configuration, the tail plug 30 is fitted into a rear end side of the accommodation tube 10. The tail plug 30 fitted to the rear end side of the accommodation tube 10 functions as a bottom part of the first ink tank 40A and a bottom part of the second ink tank 40B. With such a configuration, an airtight structure is formed by the rear end side of the accommodation tube 10 and the tail plug 30 fitted to the rear end side of the accommodation tube 10. Accordingly, it is possible to secure airtightness of rear end parts of the first ink tank 40A and the second ink tank 40B with such an airtight structure.

The ink induction mechanism 50 includes a first induction core 50A for inducing the first ink, a second induction core 50B for inducing the second ink, and an induction-core holding shaft 51 for holding the first induction core 50A and the second induction core 50B. The first induction core 50A and the second induction core 50B are formed to extend toward the front side from the rear side. The first induction core 50A has a structure capable of inducing the first ink in the back and forth direction, that is, in a longitudinal direction of the first induction core, and the second induction core 50B has a structure capable of inducing the second ink in the back and forth direction, that is, in a longitudinal direction of the second induction core. The first induction core 50A and the second induction core 50B may be, for example, a bundled body of fibers (PET, acryl, or nylon) or a sintered body. The first induction core 50A is not particularly limited as long as the first induction core has a cylindrical shape such as a circular cylindrical shape, an elliptic cylindrical shape, or a polygonal cylindrical shape. Similarly, the second induction core 50B is not particularly limited as long as the second induction core is a cylindrical body having a circular cylindrical shape, an elliptic cylindrical shape, or a polygonal cylindrical shape. Moreover, the first induction core 50A and the second induction core 50B may have different shapes from each other. The induction-core holding shaft 51 is not particularly limited as long as the induction-core holding shaft is a cylindrical body having a circular cylindrical shape, an elliptic cylindrical shape, or a polygonal cylindrical shape.

Figure 4:
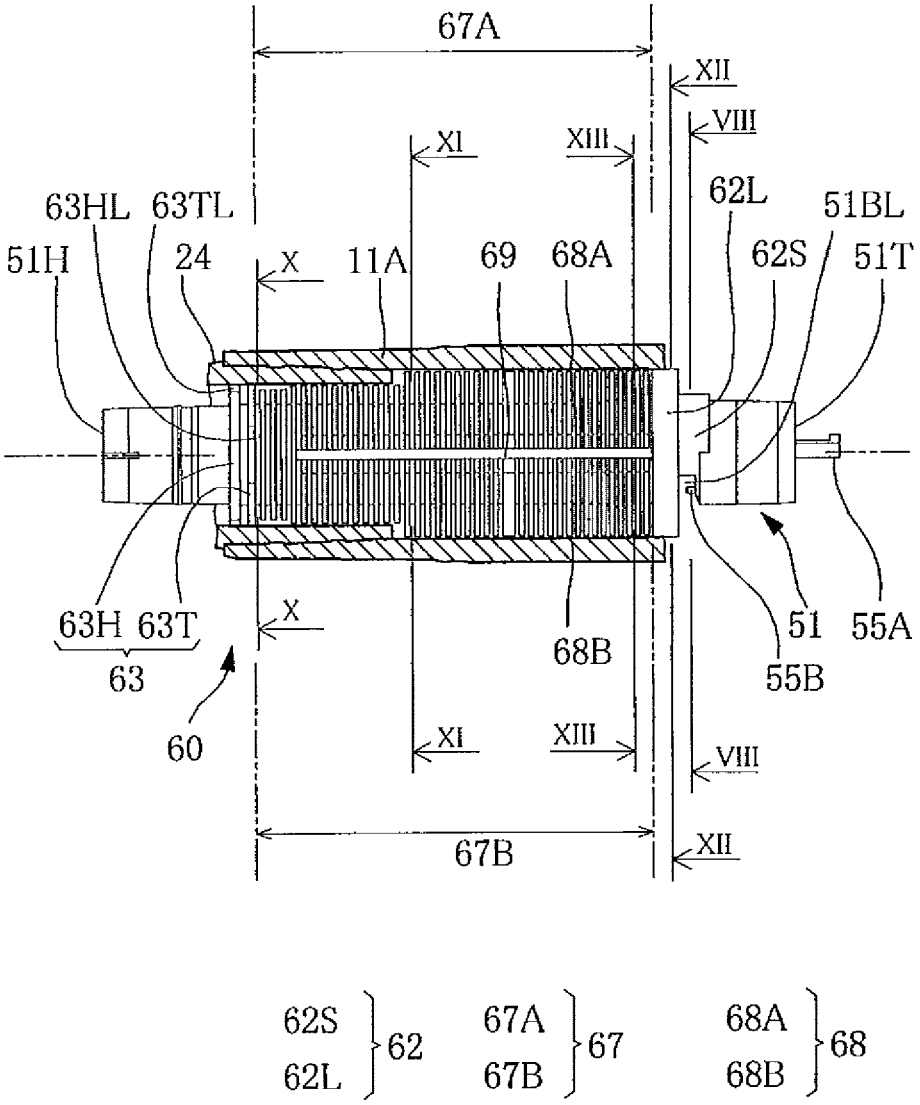
FIG. 4 is a side view illustrating an outline of the first ink induction mechanism and the first regulator mechanism.
Figure 5:
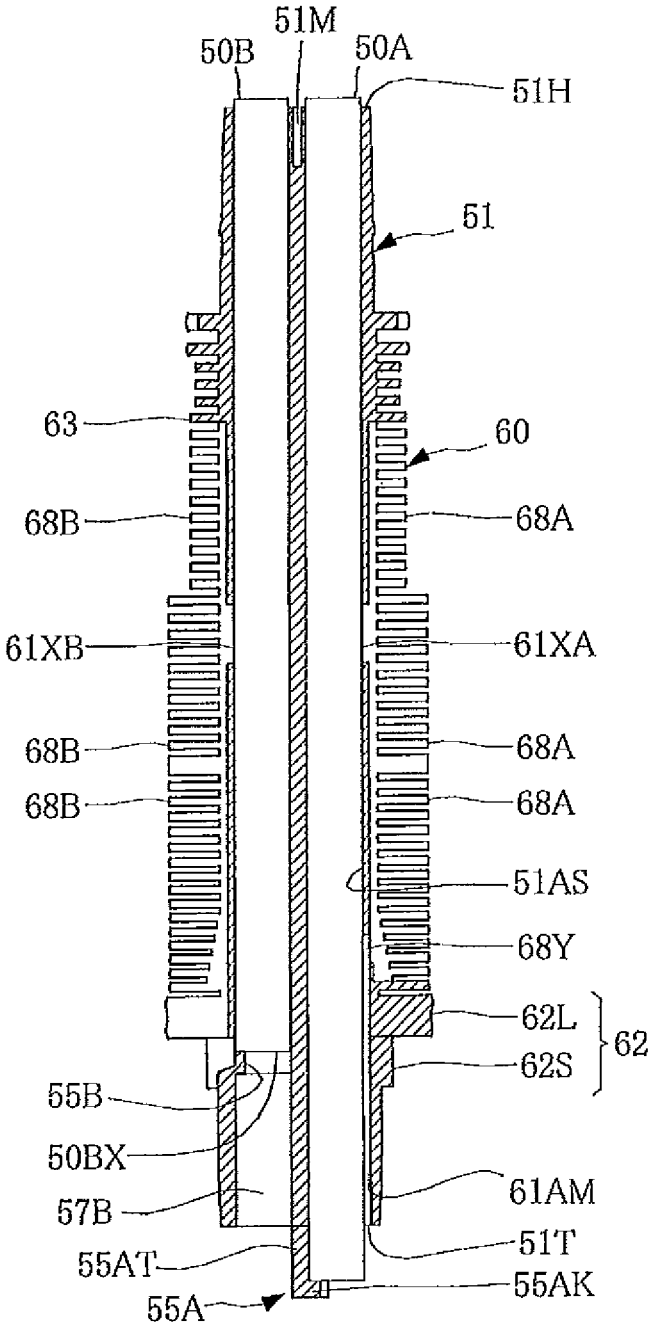
FIG. 5 is a cross-sectional view illustrating the outline of the first ink induction mechanism and the first regulator mechanism.
Figure 6:
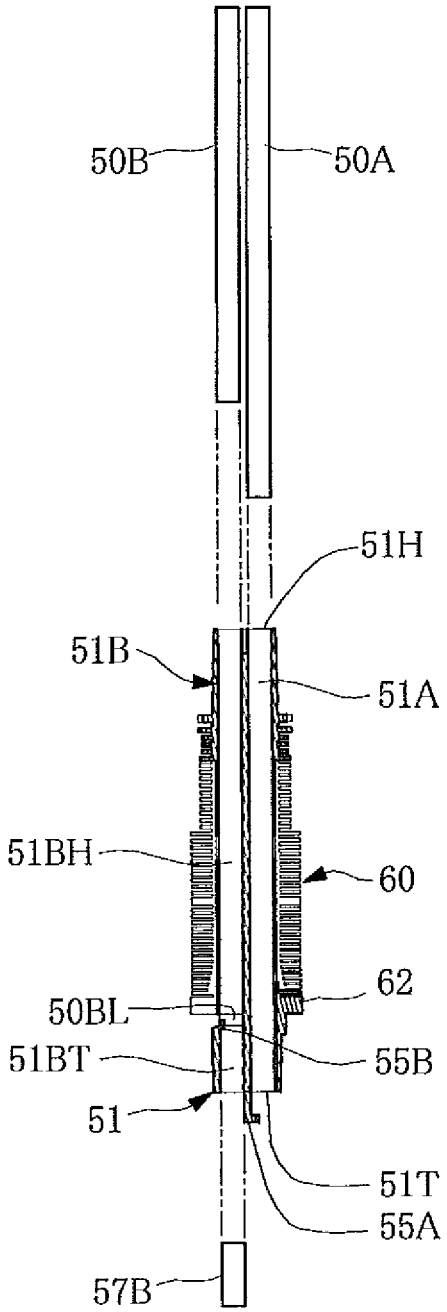
FIG. 6 is an exploded cross-sectional view illustrating the outline of the first ink induction mechanism and the first regulator mechanism.

The induction-core holding shaft 51 includes a rear end 51Y. An outer peripheral surface of the rear end 51Y has a shape capable of fitting to the inner peripheral part of the tube connecting part 13. An airtight structure is formed by the rear end 51Y of the induction-core holding shaft 51 and the tube connecting part 13 (see FIG. 3A). As illustrated in FIGS. 4 to 6, the induction-core holding shaft 51 includes a first through hole 51A that penetrates from a rear end shaft surface 51T to a front end shaft surface 51H, and a second through hole 51B that penetrates from the rear end shaft surface 51T to the front end shaft surface 51H. The first through hole 51A and the second through hole 51B are formed to be substantially parallel to each other. A shape of the first through hole 51A is not particularly limited, and the first through hole may have any shape as long as the first induction core 50A can be inserted into the first through hole. Similarly, a shape of the second through hole 51B is not particularly limited, and the second through hole may have any shape as long as the second induction core 50B can be inserted into the second through hole.

Preferably, in the induction-core holding shaft 51, a latching protrusion 55A that engages with a rear end surface of the first induction core 50A is formed on the rear end shaft surface 51T. The latching protrusion 55A includes a rear protruding part 55AT that protrudes from the rear end shaft surface 51T to the rear side, and a rear-end-surface latching part 55AK that is formed at the rear protruding part 55AT. The rear-end-surface latching part 55AK extends from the rear protruding part 55TT to a position where the rear-end-surface latching part is overlapped with an opening surface of the first through hole 51A. The first induction core 50A is inserted into the first through hole 51A from the front side. Since the rear end surface of the first induction core 50A inserted into the first through hole 51A is latched to the rear-end-surface latching part 55AK, a position of the first induction core 50A in the first through hole 51A is determined. Preferably, a front end of the first induction core 50A whose position has been determined protrudes toward the front side than the front end shaft surface 51H of the induction-core holding shaft 51.

Figure 7:
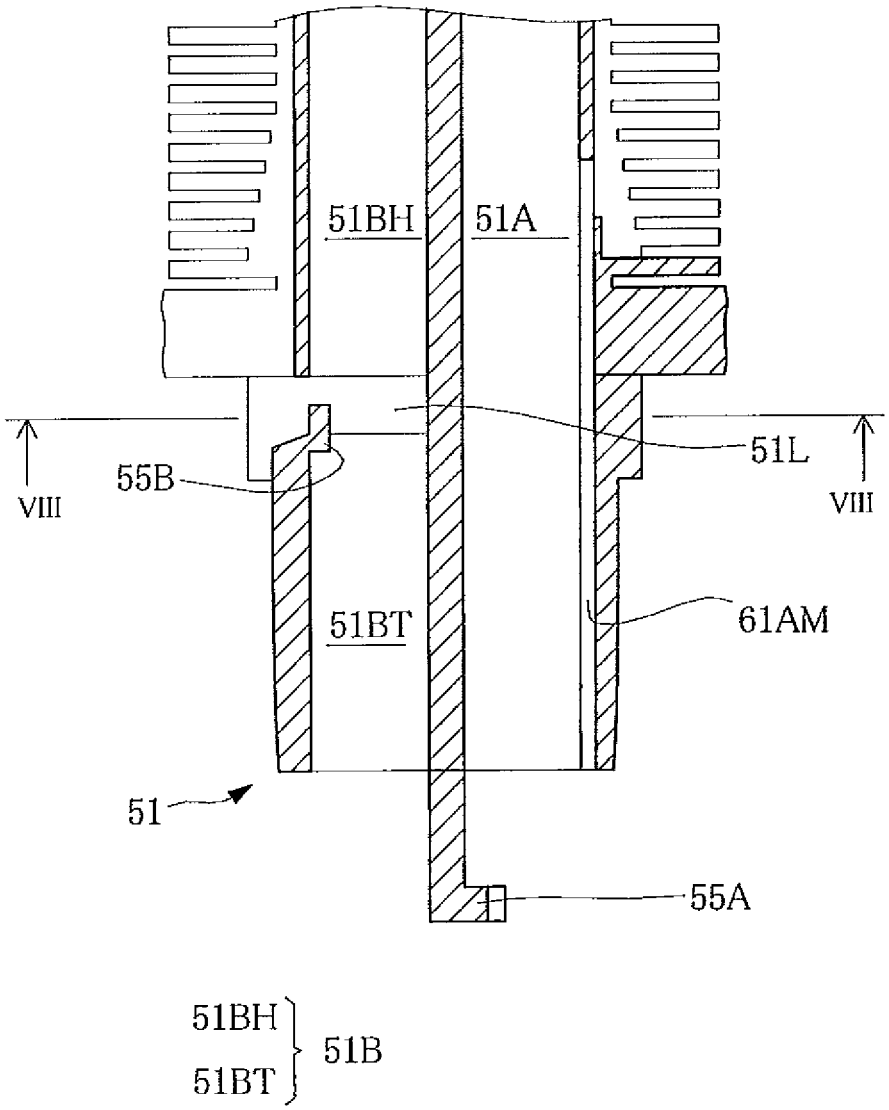
FIG. 7 is a cross-sectional view illustrating an outline of a rear end part of a first induction-core holding shaft and the first regulator mechanism.
Figure 8:
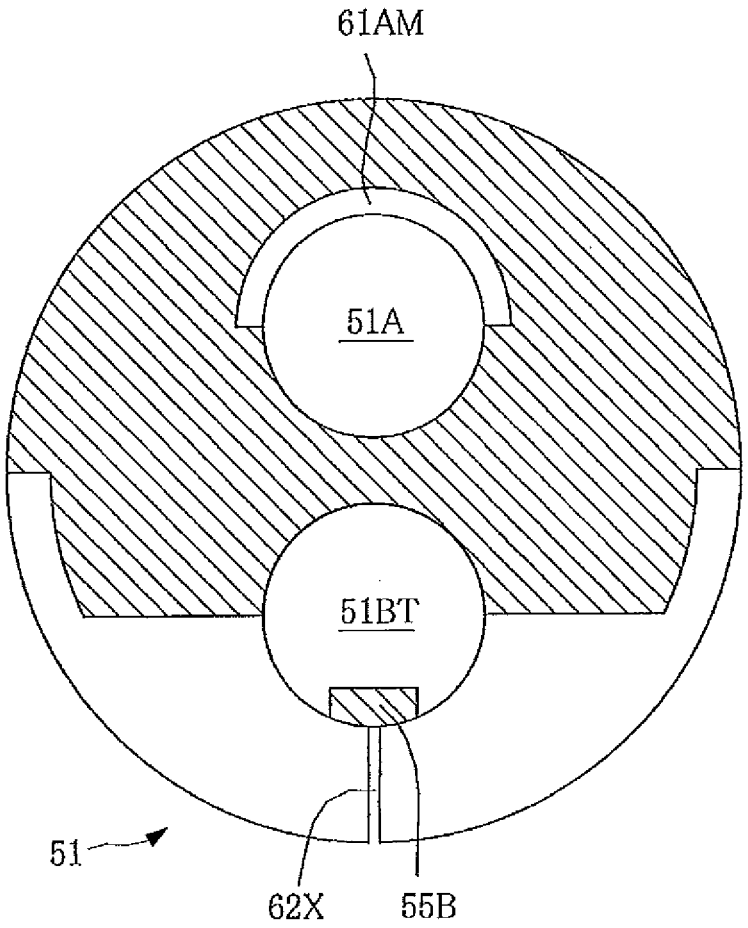
FIG. 8 is a cross-sectional view taken along line VIII-VIII of the first induction-core holding shaft.

As illustrated in FIGS. 7 and 8, the induction-core holding shaft 51 includes a cutoff part 51L formed in a middle part of the induction-core holding shaft in a longitudinal direction. Since a middle part of the second through hole 51B is exposed to an outside of the induction-core holding shaft 51 due to the formation of the cutoff part 51L, the second through holes 51B is divided into a front hole 51BH located on the front side and a rear hole 51BT located on a rear side. Further, the induction-core holding shaft 51 includes a latching protrusion 55B that protrudes from an inner wall surface of the rear hole 51BT. As illustrated in FIGS. 3A and 6, the second induction core 50B is inserted into the second through hole 51B from the front side. Since a rear end of the second induction core 50B inserted into the second through hole 51B is latched to the latching protrusion 55B, a position of the second induction core 50B in the second through hole 51B is determined. A rear end part of the second induction core 50B whose position has been determined, particularly, a rear end surface 50BX of the second induction core 50B, is opened to the outside of the induction-core holding shaft 51 due to the formation of the cutoff part 51L. Preferably, a front end of the second induction core 50B whose position is determined protrudes toward the front side than the front end shaft surface 51H of the induction-core holding shaft 51.

Further, the ink induction mechanism 50 includes a clogging plug 57B. The clogging plug 57B is disposed in the rear hole 518T. When the clogging plug 57B is inserted into the rear hole 51BT from the rear side, a front end of the clogging plug 57B is latched to the latching protrusion 55B. A position of the clogging plug 57B in the second through hole 51B is determined by the latching protrusion 55B.

A rear end side of the first induction core 50A whose position is determined protrudes from the rear end shaft surface 51T toward the rear side. For this reason, by inserting a rear end side of the induction-core holding shaft 51 into the front end opening 12H of the small-large housing part 12 (see FIG. 2), a rear end of the first induction core 50A is opened within the first ink tank 40A (see FIG. 3A). Since the clogging plug 57B clogs an opening of the rear end side of the second through hole 51B, even though the rear end side of the induction-core holding shaft 51 is inserted into the front end opening 12H of the small-diameter tube part 12 (see FIG. 2), the second induction core 50B is blocked from the first ink of the first ink tank 40A (see FIG. 3A). The rear end opening of the second through hole 51B may be clogged by the induction-core holding shaft 51 without being opened. When the rear end opening of the second through hole 51B is clogged, the clogging plug 57B may not be provided.

As illustrated in FIGS. 5 and 6, the regulator mechanism 60 includes a flange structure 62 that protrudes from an outer peripheral surface of a rear end part of the induction-core holding shaft 51.

The flange structure 62 includes a small-diameter flange 62S and a large-diameter flange 62L that are sequentially provided toward a front end side from a rear end side. The flange structure 62 has a shape capable of engaging with the tube connecting part 13 by the small-diameter flange 62S and the large-diameter flange 62L. By inserting the rear end side of the induction-core holding shaft 51 into a front end side of the small-diameter tube part 12, the flange structure 62 is latched to the tube connecting part 13 (see FIG. 3A). Thus, positions of the ink induction mechanism 50 and the regulator mechanism 60 are determined in the accommodation tube 10. An airtight structure is formed by the flange structure 62 and the tube connecting part 13 engaging with the flange structure 62.

A space (first ink tank) 40A that accommodates the first ink is formed inside the small-diameter tube part 12 by the tail plug 30, the ink induction mechanism 50 and the regulator mechanism 60 (see FIG. 1). Moreover, a closed space (second ink tank) 40B that accommodates the second ink is formed in a space between the small-diameter-tube accommodating part 11B and the small-diameter tube part 12 by the tube connecting part 13 and the large-diameter engaging tube 31 of the tail plug 30 (see FIG. 1).

Figure 3B:
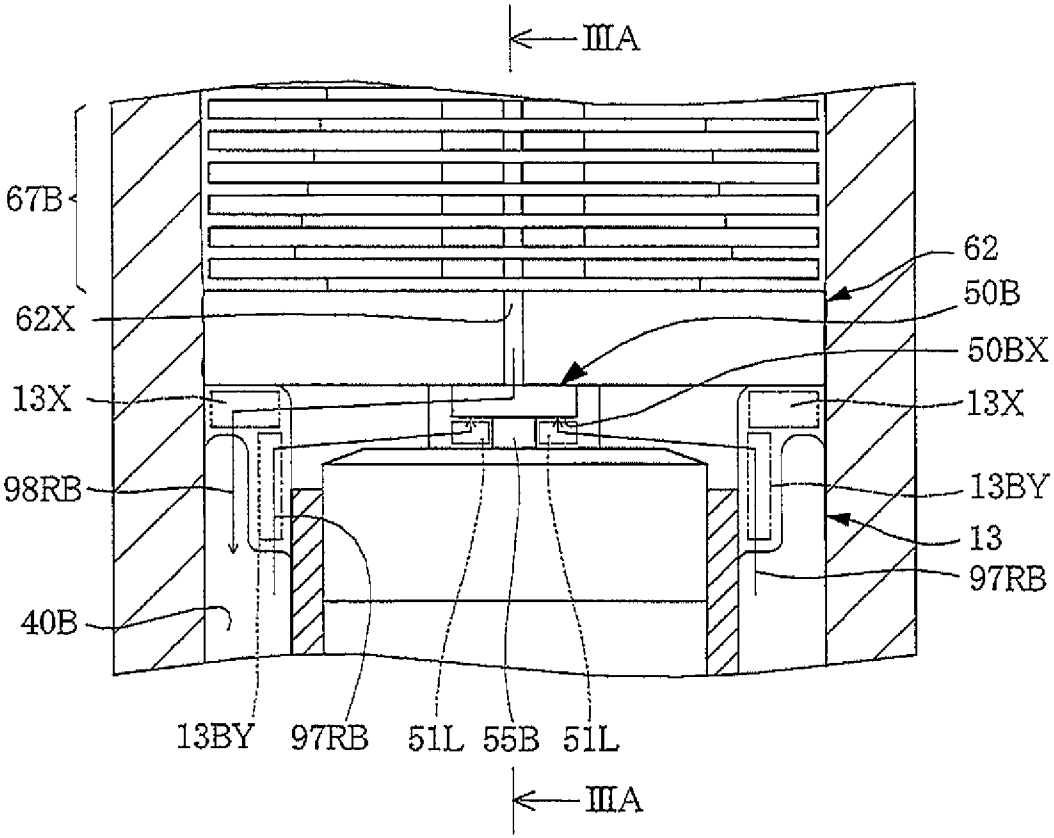
FIG. 3B is a cross-sectional view taken along line IIIB-IIIB which enlarges the part of the first ink tank mechanism that is fitted to the first ink induction mechanism and the first regulator mechanism.

As illustrated FIGS. 3B and 4, the tube connecting part 13 includes a second ink-tank communicating hole 13BY. The second ink-tank communicating hole 13BY is formed in the front protruding part 13B so as to communicatively connect the second ink tank 40B and the cutoff part 51L. By forming the second ink-tank communicating hole 13BY, the second ink tank 40B is communicatively connected to the second induction core 50B through the cutoff part 51L. With such a configuration, the second ink accommodated in the second ink tank 40B can reach the rear end surface 50BX of the second induction core 50B through the second ink-tank communicating hole 13BY and the cutoff part 51B.

Figure 9:
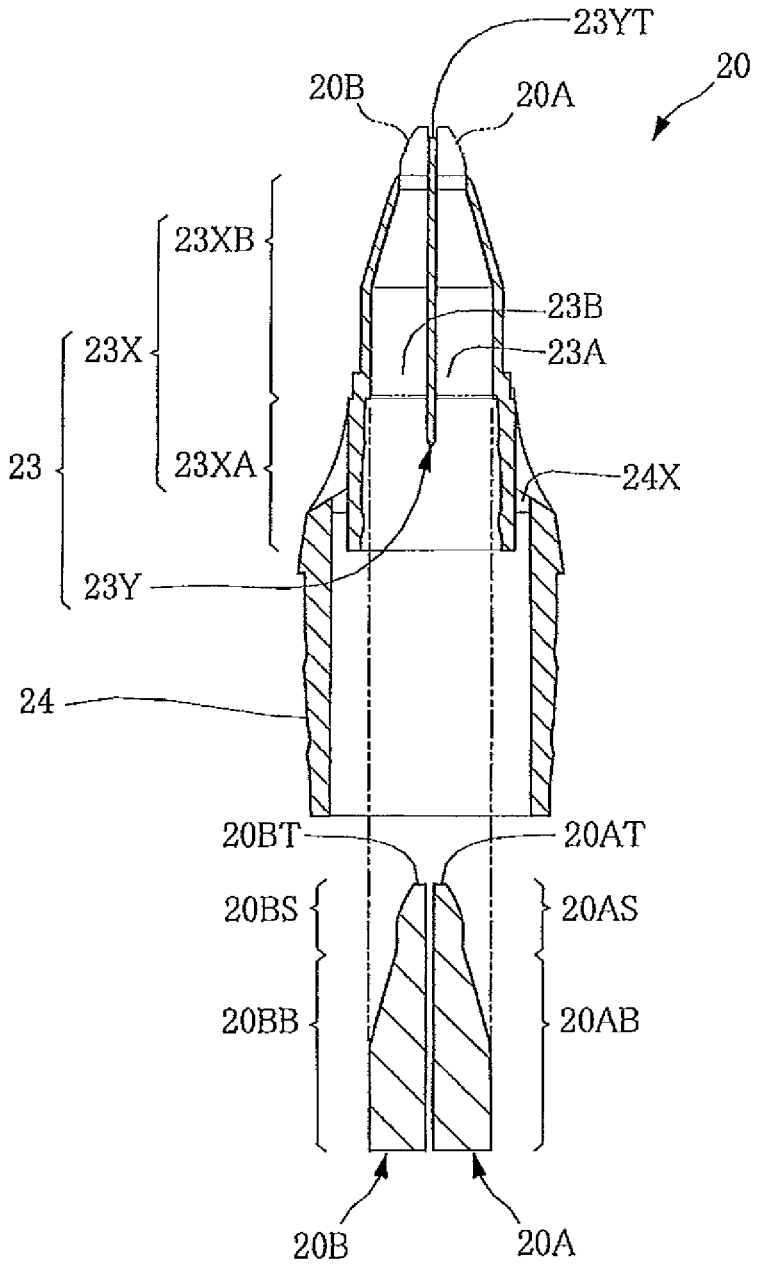
FIG. 9 is an exploded cross-sectional view illustrating an outline of a first pen tip mechanism.

As illustrated in FIG. 9, the pen tip mechanism 20 includes a first pen tip 20A that holds the first ink, a second pen tip 20B that holds the second ink, a pen-tip holding tube 23 that holds the first pen tip 20A and the second pen tip 20B, and a shaft latching tube 24 that connects the pen-tip holding tube 23 to the large-diameter tube part 11. Preferably, the first pen tip 20A and the second pen tip 20B that are held by the pen-tip holding tube 23 are parallel to each other. For example, the first pen tip 20A has a semicircular cylindrical shape, and the second pen tip 20B has a semicircular cylindrical shape. The first pen tip 20A and the second pen tip 20B are preferably arranged to form one circular cylindrical body. The first and second pen tips 20A and 20B may be, for example, a bundled body of fibers (PET, acryl, or nylon), a sintered body, or felt.

The pen-tip holding tube 23 includes a holding-tube main body 23X, and a pen-tip partitioning plate 23Y provided in a hollow part of the holding-tube main body 23X. The holding-tube main body 23X includes a shaft accommodating tube part 23XA that accommodates a front end part of the induction-core holding shaft 51 (see FIG. 2), and a pen-tip accommodating tube part 23XB that accommodates a base part 20AB of the first pen tip 20A and a base part 20BB of the second pen tip 20B. The pen-tip accommodating tube part 23XB and the shaft accommodating tube part 23XA are sequentially arranged from the front side toward the rear side, and are connected to each other. An inner peripheral surface of the shaft accommodating tube part 23XA has a shape capable of engaging with an outer peripheral surface of the front end part of the induction-core holding shaft 51 (see FIG. 2). An airtight structure is formed by the inner peripheral surface of the shaft accommodating tube part 23XA and the outer peripheral surface of the front end part of the induction-core holding shaft 51 (see FIG. 2).

The pen-tip partitioning plate 23Y is disposed inside the pen-tip accommodating tube part 23XB so as to include a shaft of the pen-tip accommodating tube part 23XB. The inside of the pen-tip accommodating tube part 23XB is partitioned into a first pen-tip holding hole 23A and a second pen-tip holding hole 23B by the pen-tip partitioning plate 23Y. The base part 20AB of the first pen tip 20A is fitted into the first pen-tip holding hole 23A, and a front end part 20AS of the first pen tip 20A protrudes from a front end opening of the pen-tip accommodating tube part 23XB. Similarly, the base part 20BB of the second pen tip 20B is fitted into the second pen-tip holding hole 23B, and a front end part 20BS of the second pen tip 20B protrudes from the front end opening of the pen-tip accommodating tube part 23XB. A protruding amount of the first pen tip 20A from the front end opening of the pen-tip holding tube 23 is equal to a protruding amount of the second pen tip from the front end opening of the pen tip holding tube. The protruding amounts of the first pen tip 20A and the second pen tip from the front end opening of the pen-tip holding tube 23 may be different from each other.

A rear end of the pen-tip partitioning plate 23Y can be located inside the shaft accommodating tube part 23XA, and can be latched to a latching groove 51M (see FIG. 5) formed at the front end shaft surface 51H of the induction-core holding shaft 51. With such a configuration, the pen-tip holding tube 23 is latched in a circumferential direction through latching of the pen-tip partitioning plate 23Y and the latching groove 51M. Furthermore, a front end surface 23YT of the pen-tip partitioning plate 23Y is located in a rear side than a front end surface 20AT of the first pen tip 20A and a front end surface 20BT of the second pen tip 20B (see FIG. 9). Preferably, a front end of the pen-tip partitioning plate 23Y protrudes from the pen-tip holding tube 23, that is, an opening of a front end side of the holding-tube main body 23X.

Since an outer peripheral surface of the shaft latching tube 24 has a shape capable of being latched to an inner peripheral surface (see FIG. 2) of a front end side of the large-diameter tube part 11, the shaft latching tube 24 can be latched to the accommodation tube 10 (see FIG. 1). Moreover, a vent hole 24X that communicatively connects the inside and outside of the shaft latching tube 24 is formed in the shaft latching tube 24.

As illustrated in FIG. 2, when the pen tip mechanism 20 is inserted into the front end side of the accommodation tube 10, the outer peripheral surface of the shaft latching tube 24 engages with the inner peripheral surface of the large-diameter tube part 11, and the pen-tip partitioning plate 23Y engages with the latching groove 51M. As a result, the pen tip mechanism 20 is latched by the large-diameter tube part 11 and the regulator mechanism 60 attached to the accommodation tube 10. When the pent tip mechanism 20 is inserted into the front end side of the accommodation tube 10, the first pen tip 20A is pressed against the first induction core 50A, and the second pen tip 20B is pressed against the second core 50B. Accordingly, the first ink can be circulated between the first pen tip 20A and the first induction core 50A, and the second ink can be circulated between the second pen tip 20B and the second induction core 50B.

Figure 10:
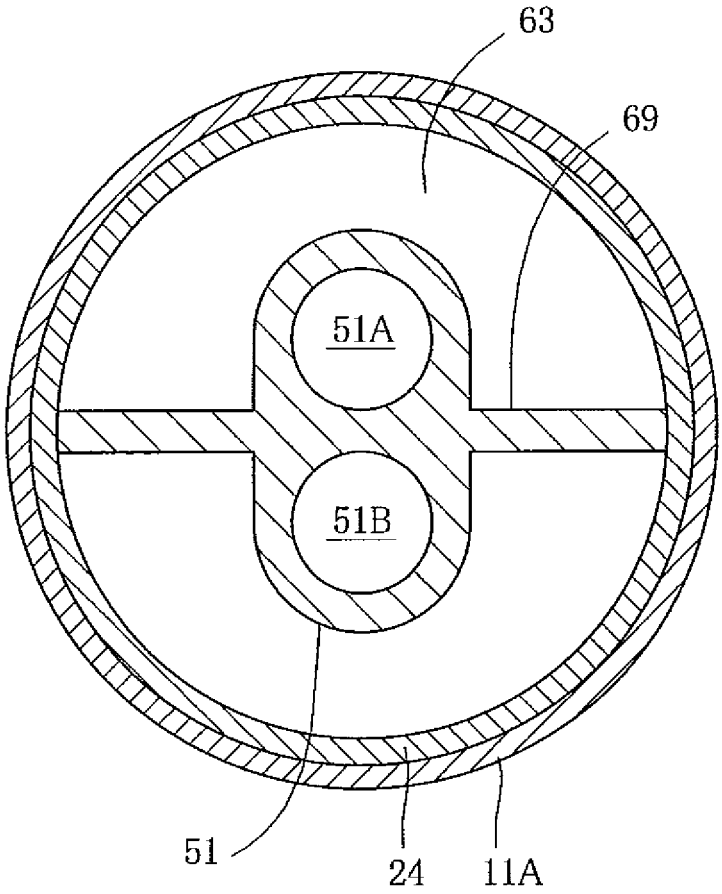
FIG. 10 is a cross-sectional view taken along line X-X of the first regulator mechanism.

As illustrated in FIGS. 4 and 10, the regulator mechanism 60 further includes a clogging unit 63 that is disposed at the induction-core holding shaft 51 located on the front side than the flange structure 62, a regulator flow path 67 that is formed between the flange structure 62 and the clogging unit 63, a regulator brim 68 that is disposed at the regulator flow path 67, and a regulator partitioning plate 69 that partitions the regulator flow path 67.

In the clogging unit 63, a front clogging brim 63H and a rear clogging brim 63T are sequentially arranged toward the rear side from the front side. The front clogging brim 63H and the rear clogging brim 63T extend from an outer peripheral surface of the induction-core holding shaft 51 toward the inner peripheral surface of the large-diameter tube part 11. Front ends of the front clogging brim 63H and the rear clogging brim 63T reach an inner peripheral surface of the shaft latching tube 24 inserted into the front end side of the large-diameter tube part 11. Cutoff parts 63HL and 63TL are respectively formed at the front clogging brim 63H and the rear clogging brim 63T. The front clogging brim 63H and the rear clogging brim 63T are arranged such that the cutoff part 63HL of the front clogging brim 63H and the cutoff part 63TL of the rear clogging brim 63T are not overlapped. For this reason, in a space between the cutoff part 63HL and the cutoff part 63TL, a liquid does not pass, and only a gas passes. By forming the front clogging brim 63H and the rear clogging brim 63T, the regulator flow path 67 is communicatively connected to the outside of the writing instrument 2 through the vent hole 24X.

The regulator flow path 67 is a ring-shaped space formed between the outer peripheral surface of the induction-core holding shaft 51 and the inner peripheral surface of the large-diameter tube part 11 in a diametric direction of the induction-core holding shaft 51, and extends from the flange structure 62 to the clogging unit 63 in the back and forth direction.

Figure 11:
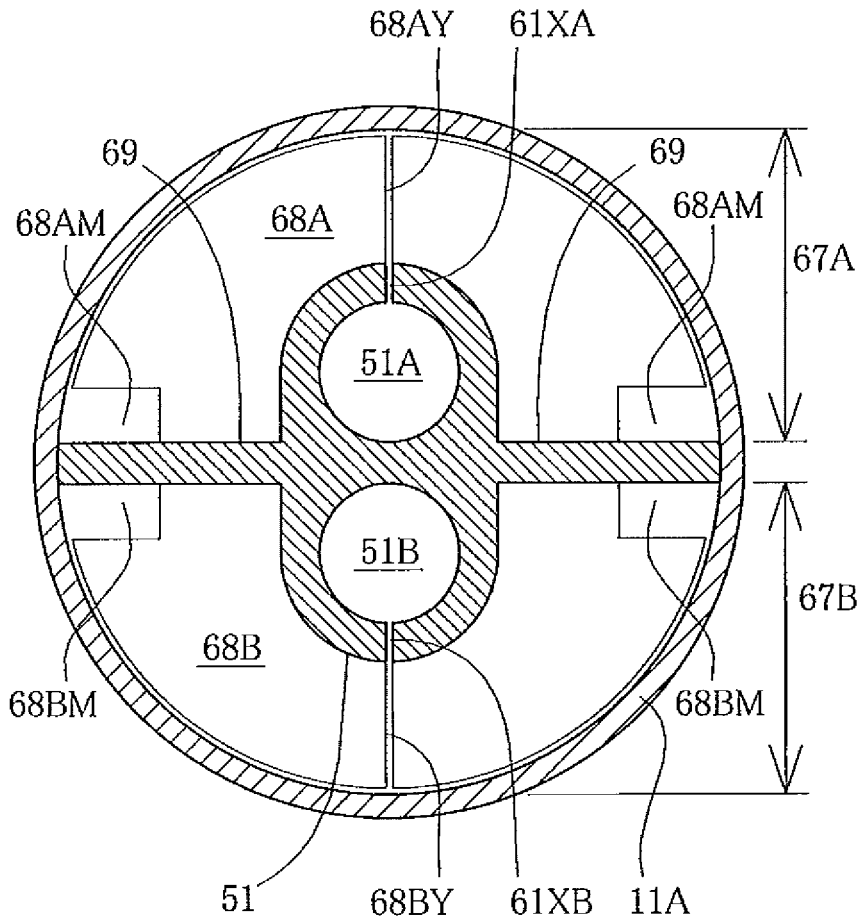
FIG. 11 is a cross-sectional view taken along line XI-XI of the first regulator mechanism.

As illustrated in FIGS. 5 and 11, the regulator mechanism 60 may further include a first regulator communicating hole 61XA, and a second regulator communicating hole 61XB. The first regulator communicating hole 61XA is formed in the induction-core holding shaft 51 to communicatively connect the first through hole 51A and the regulator flow path 67. Further, the second regulator communicating hole 61XB is formed in the induction-core holding shaft 51 to communicatively connect the second through hole 51B and the regulator flow path 67. An outer peripheral surface of the first induction core 50A inserted into the first through hole 51A is exposed through the first regulator communicating hole 61XA, and an outer peripheral surface of the second induction core 50B inserted into the second through hole 51B is exposed through the second regulator communicating hole 61XB.

The regulator partitioning plate 69 extends in the back and forth direction, and partitions the regulator flow path 67 into two flow paths (first regulator flow path 67A and second regulator flow path 67B). The first regulator flow path 67A is communicatively connected to the first regulator communicating hole 61XA, and is blocked from the second regulator communicating hole 61XB by the regulator partitioning plate 69. Similarly, the second regulator flow path 67 is communicatively connected to the second regulator communicating hole 61XB, and is blocked from the first regulator communicating hole 61XA by the regulator partitioning plate 69. As illustrated in the drawings, the regulator partitioning plate 69 is provided to pass through a center of the accommodation tube 10. The regulator mechanism 60 has a half-split structure by such a regulator partitioning plate 69.

The regulator brim 68 includes first regulator brims 68A formed at the first regulator flow path 67A, and second regulator brims 68B formed at the second regulator flow path 67B. The first regulator brim 68A having a semicircular shape or a fan shape extends to protrude from the outer peripheral surface of the induction-core holding shaft 51, and a front end thereof approaches the large-diameter tube part 11, that is, the inner peripheral surface of the induction-mechanism accommodating part 11A. The first regulator brim 68A includes a first slit 68AY that extends in the diametric direction. The first slit 68AY extends from an outer peripheral end of the first regulator brim 68A to the outer peripheral surface of the induction-core holding shaft 51. The first regulator communicating hole 61XA and the first slit 68AY primarily serves as a circulation path of the first ink. Further, a gap between the first regulator brim 68A and the large-diameter tube part 11 primarily serves as a circulation path of air.

Similarly to the first regulator brim 68A, the second regulator brim 68B having a semicircular shape or a fan shape extends to protrude from the outer peripheral surface of the induction-core holding shaft 51, and a front end thereof approaches the large-diameter tube part 11, that is, the inner peripheral surface of the induction-mechanism accommodating part 11A. The second regulator brim 68B includes a second slit 68BY that extends in the diametric direction. The second slit 68BY extends from an outer peripheral surface of the second regulator brim 68B to the outer peripheral surface of the induction-core holding shaft 51. The second regulator communicating hole 61XB and the second slit 68BY primarily serves as a circulation path of the second ink. Moreover, a gap between the second regulator brim 68B and the large-diameter tube part 11 primarily serves as a circulation path of air. Other parts of the second regulator brim 68B are the same as those of the first regulator brim 68A, and, thus, detailed description thereof will not be presented.

Preferably, the first slit 68AY is formed to be in a straight line with the first regulator communicating hole 61XA. Similarly, the second slit 68BY is preferably formed to be in a straight line with the second regulator communicating hole 61XB. First engaging cutoff parts 68AM that extend in the back and forth direction are formed at both ends of an outer peripheral part of the first regulator brims 68A. Second engaging cutoff part 68BM that extend in the back and forth direction are formed at both ends of an outer peripheral part of the second regulator brims 68B. Furthermore, positioning ribs (not illustrated) that extend in the back and forth direction are formed on the inner peripheral surface of the large-diameter tube part 11. When the induction-core holding shaft 51 is inserted into the large-diameter tube part 11, the positioning ribs engage with the first engaging cutoff parts 68AM or the second engaging cutoff parts 68BM. With such a configuration, the induction-core holding shaft 51 inserted into the large-diameter tube part 11 is latched in the circumferential direction by the first engaging cutoff parts 68AM, the second engaging cutoff parts 68BM and the positioning ribs.

As illustrated in FIG. 4, the first regulator brims 68A are arranged from the front side toward the rear side at a predetermined distance. A gap between the first regulator brims 68A adjacent to each other in the back and forth direction increases as it is close to the rear side from the front side. Thus, the first slit 68AY formed at one first regulator brim 68A of the adjacent first regulator brims 68A, and the first slit 68AY formed at the other first regulator brim 68A are preferably formed to be the same phase. That is, these first slits are preferably overlapped with each other when viewed in the back and forth direction. The second regulator brim 68B is similar to the first regulator brim 68A, and, thus, detailed description thereof will not be presented.

As mentioned above, the first regulator flow path 67A is formed by the plurality of first regulator brims 68A formed to have a predetermined shape and to be arranged in a predetermined pattern. The first regulator flow path 67A functions as a temporary accommodation space of the first ink and a circulation space of air introduced from the first pen tip 20A. Similarly, the second regulator flow path 67B is formed by the plurality of second regulator brims 68B formed to have a predetermined shape and to be arranged in a predetermined pattern. The second regulator flow path 67B functions as a temporary accommodation space of the second ink and a circulation space of air introduced from the second pen tip 20B. Here, the temporary accommodation space of the ink refers to a space that can temporarily accommodate the ink within the ink tank. By forming such a temporary accommodation space of the ink, even when there is a variation in pressure within the ink tank, it is possible to maintain a pressure balance between the outside of the writing instrument and the inside of the ink tank.

Figure 12:
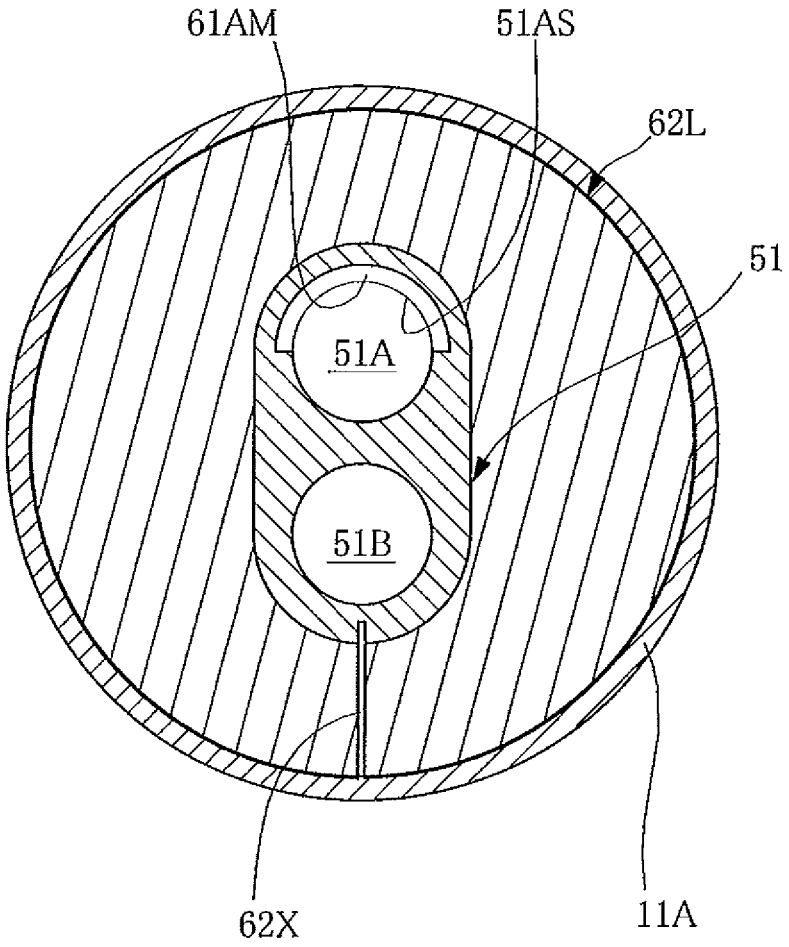
FIG. 12 is a cross-sectional view taken along line XII-XII of the first regulator mechanism.

As illustrated in FIGS. 3A and 3B, a tube connecting slit 13X is formed in the tube connecting part 13. The tube connecting slit 13X is formed in the connecting part 13C to communicatively connect the second ink tank 40B and the second regulator flow path 67B. The second ink-tank communicating hole 13BY and tube connecting slit 13X may be integrally formed. As illustrated in FIGS. 3B and 12, a flange slit 62X is formed in a part of the flange structure 62 where the second regulator flow path 67B is formed. The second regulator flow path 67B and the second ink tank 40B are communicatively connected through the flange slit 62X and the tube connecting slit 13X.

Figure 13:
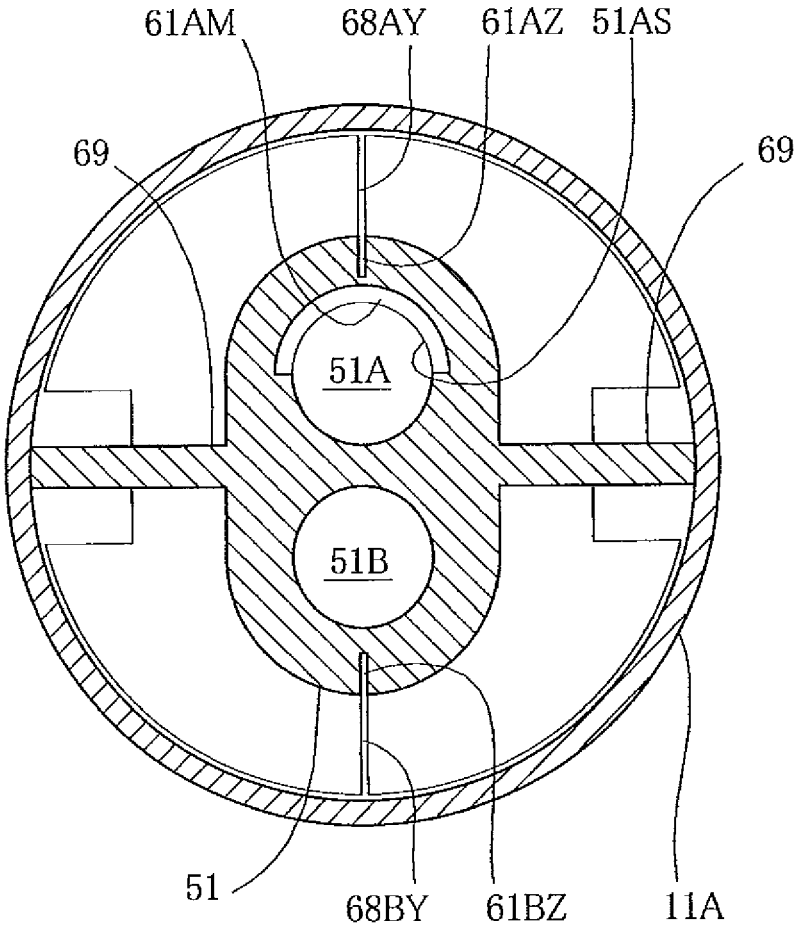
FIG. 13 is a cross-sectional view taken along line XIII-XIII of the first regulator mechanism.

As illustrated in FIGS. 3A, 12 and 13, a first ink-tank communicating hole 61AM is formed in an inner wall surface 51AS where the first through hole 51A is formed. The first ink-tank communicating hole 61AM extends in the back and forth direction. A front end of the first ink-tank communicating hole 61AM is opened in the first regulator flow path 67A. Meanwhile, a rear end of the first ink-tank communicating hole 61AM is opened to the rear end shaft surface 51T of the induction-core holding shaft 51. The first regulator flow path 67A is communicatively connected to the first ink tank 40A through the first ink-tank communicating hole 61AM. Preferably, the first ink-tank communicating hole 61AM is formed in a part of the inner wall surface 51AS of the first through hole 51A which is farther from the second through hole 51B.

Slits 61AZ and 61BZ may be formed in the induction-core holding shaft 51. The slit 61AZ functions as a temporary accommodation space of the first ink, and the slit 61BZ functions as a temporary accommodation space of the second ink. The slits 61AZ and 61BZ are formed between the flange structure 62 and the clogging unit 63 to extend in the back and forth direction. The slit 61AZ is communicatively connected to the first regulator flow path 67A, and the slit 61BZ is communicatively connected to the second regulator flow path 67B. The slit 61AZ is formed to be in a straight line with the first slit 68AY. Similarly, the slit 61BZ is formed to be in a straight line with the second slit 68BY. While the slit 61AZ extends from the outer peripheral surface of the induction-core holding shaft 51 toward the first through hole 51A, an end part close to the first through hole 51A is located in front of an inner wall surface of the first through hole 51A. That is, the slit 61AZ is not communicatively connected to the first regulator flow path 67A and the first through hole 51A. Similarly, while the slit 61BZ extends from the outer peripheral surface of the induction-core holding shaft 51 toward the second through hole 51B, an end part close to the second through hole 51B is located in front of an inner wall surface of the second through hole 51B. That is, the slit 61BZ is not communicatively connected to the second regulator flow path 68B and the second through hole 51B.

Preferably, as a groove between the first regulator brims 68A is close to the rear side from the front side, a depth thereof is gradually reduced (see FIG. 3A). With such a configuration, as a part of the groove whose depth is gradually reduced, a part to be desired to accommodate ink is preferably set. For example, a part of the first regulator flow path 67A in the vicinity of an opening end of the first ink-tank communicating hole 61AM, or a part of the second regulator flow path 67B in the vicinity of an opening end of the flange slit 62X is set as the part of the groove whose depth is gradually reduced.

Next, a method of manufacturing the writing instrument 2 will be described.

Firstly, the accommodation tube 10, the pen tip mechanism 20, the tail plug 30, the ink induction mechanism 50 and the regulator mechanism 60 are prepared as illustrated in FIG. 2. In this case, in the induction-core holding shaft 51, the positions of the first and second induction cores 50A and 50B and the clogging plug 57B are determined at determined parts of the first and second through holes 51A and 52. Furthermore, the regulator mechanism 60 is formed at the induction-core holding shaft 51 of the ink induction mechanism 50.

Here, a tail-plug attaching step of attaching the tail plug 30 to the rear end part of the accommodation tube 10 is performed. The tail-plug attaching step is performed until an airtight structure is formed by the rear end side of the accommodation tube 10 and the tail plug 30. Through the tail plug attaching step, the first ink tank 40A and the second ink tank 40B are formed at the accommodation tube 10.

Subsequently, a first ink filling step of filling the first ink tank 40A with the first ink and a second ink filling step of filling the second ink tank 40B with the second ink are performed. Any one step of the first ink filling step and the second ink filling step may be firstly performed.

Thereafter, an insertion step of inserting the rear end 51Y of the induction-core holding shaft 51 into the front end opening of the small-diameter tube part 12 is performed. The insertion step is performed until an airtight structure is formed by the rear end 51Y of the induction-core holding shaft 51 and the tube connecting part 13.

Subsequently, a pen-tip-mechanism attaching step of attaching the pen tip mechanism 20 into the front opening of the large-diameter tube part 11 is performed. Through the pen-tip-mechanism attaching step, the pen tip mechanism 20 is latched by the large-diameter tube part 11 and the regulator mechanism 60 attached to the accommodation tube 10.

Next, a method of using the writing instrument 2 will be described.

As illustrated in FIG. 1, the writing instrument 2 includes the first ink tank 40A that accommodates the first ink, the second ink tank 40B that accommodates the second ink, the first pen tip 20A, the second pen tip 20B, the first induction core 50A that connects the first ink tank 40A to the first pen tip 20A, and the second induction core 50B that connects the second ink tank 40B to the second pen tip 20B. For this reason, by pressing only the first pen tip 20A against paper, only the first ink held by the first pen tip 20A can adhere onto the paper. Meanwhile, by pressing only the second pen tip 20B against the paper, only the second ink held by the second pen tip 20B can adhere on the paper. In this manner, it is easy to distinguish and write the first ink and the second ink, that is, different colors. By simultaneously pressing the first pen tip 20A and the second pen tip 20B against the paper, the first ink held by the first pen tip 20A and the second ink held by the second pen tip 20B can adhere onto the paper.

Since the ink tank 40 has a double tube structure formed by the small-diameter tube part 12 and the small-diameter-tube accommodating part 11B, it is possible to form ink tanks of different colors, that is, the first ink tank 40A and the second ink tank 40B at the accommodation tube 10. Here, after the accommodation tube 10 is partitioned into two spaces by using a partitioning member extending in the diametric direction, a plurality of ink tanks that accommodates inks of different colors may be formed in the respective spaces. However, in the structure (half-split structure) of the accommodation tube 10 having the partitioning member extending in the diametric direction, it is very difficult to form the accommodation tube 10 having a cross-sectional shape of a perfect circle due to the presence of the partitioning member extending in the diametric direction. In the writing instrument 2, since the accommodation tube 10 has a double tube structure, it is possible to form the accommodation tube 10 having the cross-sectional shape of the perfect circle while forming the plurality of ink tanks that accommodates inks of different colors.

As illustrated in FIGS. 3A and 3B, the front end part of the second ink tank 40B protrudes toward the front side from the front end part of the first ink tank 40A. Accordingly, it is easy to connect the regulator mechanism 60 and the ink tank mechanism 40 of the double tube structure. Similarly, the second ink-tank communicating hole 13BY that communicatively connects the second ink tank 40B and the second induction core 50B is located on a front end side than the first ink-tank communicating hole 61AM that communicatively connects the first ink tank 40A and the first induction core 50A, that is, on a side close to the pen tip mechanism 20. Thus, it is easy to connect the regulator mechanism 60 and the ink tank mechanism 40 of the double tube structure. Furthermore, since the rear end side of the induction-core holding shaft 51 is inserted into the front end side of the small-diameter tube part 12, it is easy to connect the regulator mechanism 60 and the ink tank mechanism 40 of the double tube structure.

Since the rear end of the first induction core 50A is released in the first ink tank 40A, the first ink accommodated in the first ink tank 40A reaches the first induction core 50A (arrow line 97RA). Since the clogging plug 57B clogs the rear end side of the second through hole 51B, the first ink accommodated in the first ink tank 40A is prevented from reaching the second through hole 51B.

Further, the cutoff part 51BL is formed in the induction-core holding shaft 51, and the second ink-tank communicating hole 13BY is formed in the tube connecting part 13. Thus, the second ink accommodated in the second ink tank 40B can reach the rear end surface 50BX of the second induction core 50B (arrow line 97RB).

As illustrated in FIG. 11, since the regulator partitioning plate 69 partitions the regulator flow path 67 into the first regulator flow path 67A and the second regulator flow path 67B, the first ink and the second ink are not mixed at the regulator flow path 67.

As illustrated in FIGS. 3A and 3B, the flange slit 62X is formed in the part of the flange structure 62 where the second regulator flow path 67B is formed, and the tube connecting slit 13X is formed in the tube connecting part 13. Thus, the second regulator flow path 67B and the second ink tank 40B are communicatively connected. As a result, the air introduced from the vent hole 24X (see FIG. 9) of the pen tip mechanism 20 can reach the second ink tank 40B after sequentially passing through the second regulator flow path 67B, the flange slit 62X and the tube connecting slit 13X (arrow line 98RB). Moreover, the first ink-tank communicating hole 61AM that communicatively connects the first regulator flow path 67A and the first ink tank 40A is formed in the inner wall surface 51AS (see FIG. 12) of the first induction core through hole 51A. Thus, the air introduced from the vent hole 24X (see FIG. 9) of the pen tip mechanism 20 can reach the first ink tank 40A after sequentially passing through the first regulator flow path 67A and the first ink-tank communicating hole 61AM (arrow line 98RA). Accordingly, even when the regulator mechanism is connected to the ink tank mechanism 40 of the double tube structure, it is possible to exhibit regulation functions of the regulator mechanism 60 of the half-split structure for the first ink and the second ink.

As illustrated in FIG. 9, since the pen-tip partitioning plate 23Y is disposed between the first pen tip 20A and the second pen tip 20B, when characters are written using one of the first pen tip 20A and the second pen tip 20B, one ink is not mixed with the other ink.

Although it has been described in the above-stated embodiment that the regulator partitioning plate 69 is formed to pass through the center of the accommodation tube 10, the present invention is not limited thereto. The regulator partitioning plate 69 may be formed to allow the center of the accommodation tube 10 to be included in one of the first regulator flow path 67A and the second regulator flow path 67B.

Although it has been described in the above-stated embodiment that the regulator partitioning plate 69 is used as a flow-path partitioning member capable of partitioning the regulator flow path 67 into the first regulator flow path 67A and the second regulator flow path 67B, the present invention is not limited thereto. That is, the flow-path partitioning member may have a shape (for example, a block shape) other than a plate shape.

Next, another embodiment different from the above-stated embodiment will be described. In the following description, the same reference numerals will be assigned to components having the same configurations as those in the above-stated embodiment, and detailed description thereof will not be presented.

Figure 14:
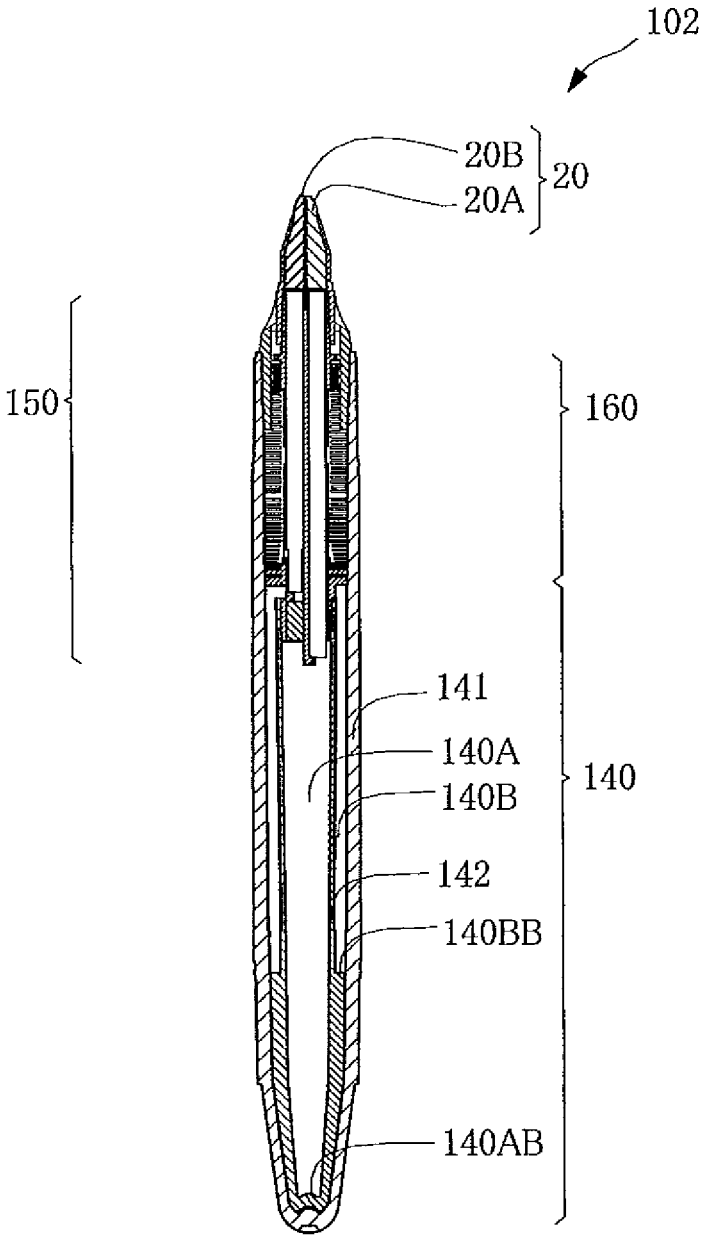
FIG. 14 is a cross-sectional view illustrating an outline of a second writing instrument.

As illustrated in FIG. 14, a writing instrument 102 includes the pen tip mechanism 20, an ink tank mechanism 140, an ink induction mechanism 150, an ink induction mechanism 150 that induces ink accommodated in the ink tank mechanism 140 to the pen tip mechanism 20, and a regulator mechanism 160 that is formed around the ink induction mechanism 150. Materials for forming the respective mechanisms 140, 150 and 160 are the same as those of the aforementioned mechanisms 40, 50 and 60.

Figure 15:
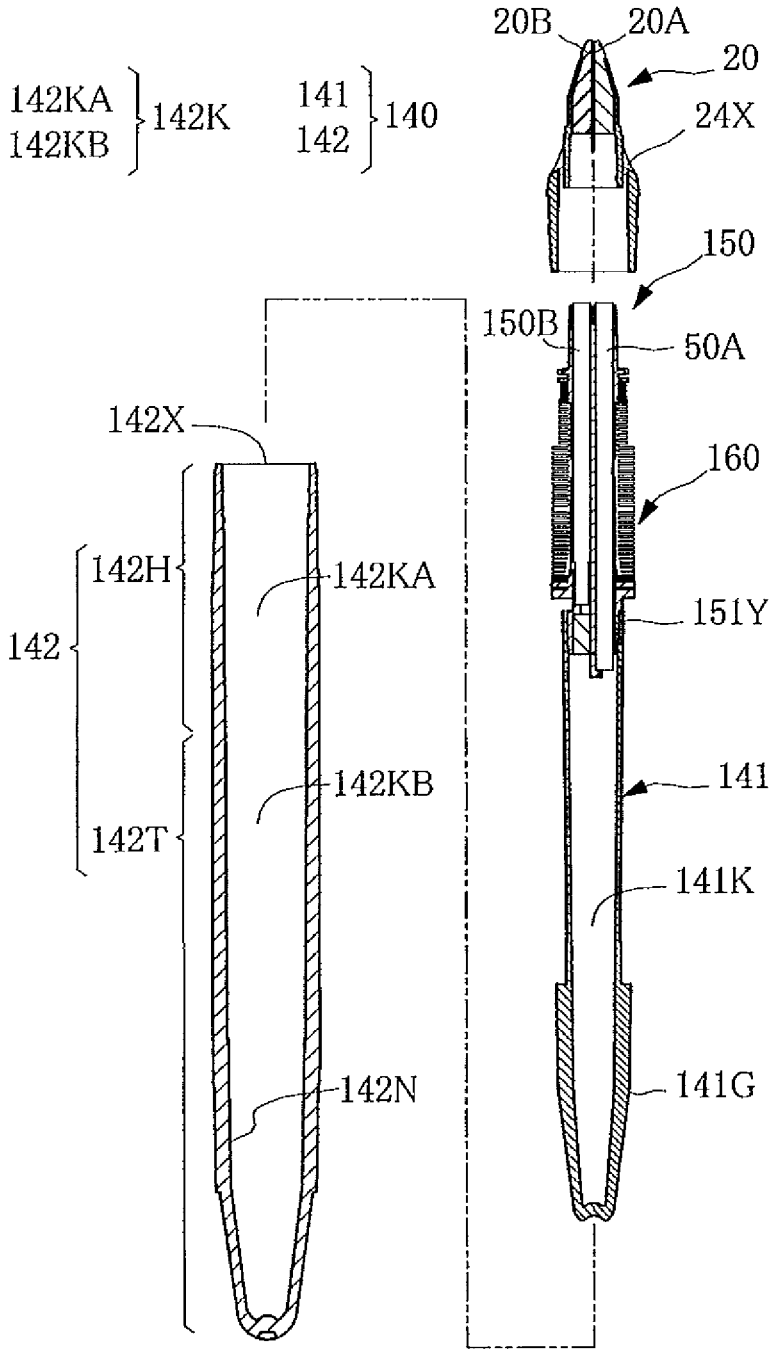
FIG. 15 is an exploded cross-sectional view illustrating the outline of the second writing instrument.

As illustrated in FIGS. 14 and 15, the ink tank mechanism 140 includes a small container 141, and a large container 142. The small container 141 and the large container 142 are formed to be separated from each other. The small container 141 includes a first ink accommodating space 141K that accommodates a first ink. The first ink accommodating space 141K of the small container 141 functions as a first ink tank 140A that accommodates the first ink.

The large container 142 includes a front part 142H that forms an accommodation space 142KA, and a rear part 142T that forms an accommodation space 142KB. The ink induction mechanism 150 and the regulator mechanism 160 are accommodated in the accommodation space 142KA, and the small container 141 is accommodated in the accommodation space 142K. In the large container 142, the accommodation space 142KA and the accommodation space 142KB are integrally formed to form an accommodation space 142K. By accommodating the small container 141 in the accommodation space 142KB of the large container 142, a second ink tank 140B that accommodates the second ink is formed between the large container 142 and the small container 141. By accommodating the ink induction mechanism 150 in the accommodation space 142KA of the large container 142, a space between the large container 142 and the ink induction mechanism 150 becomes a space for forming a regulator flow path.

Figure 16:
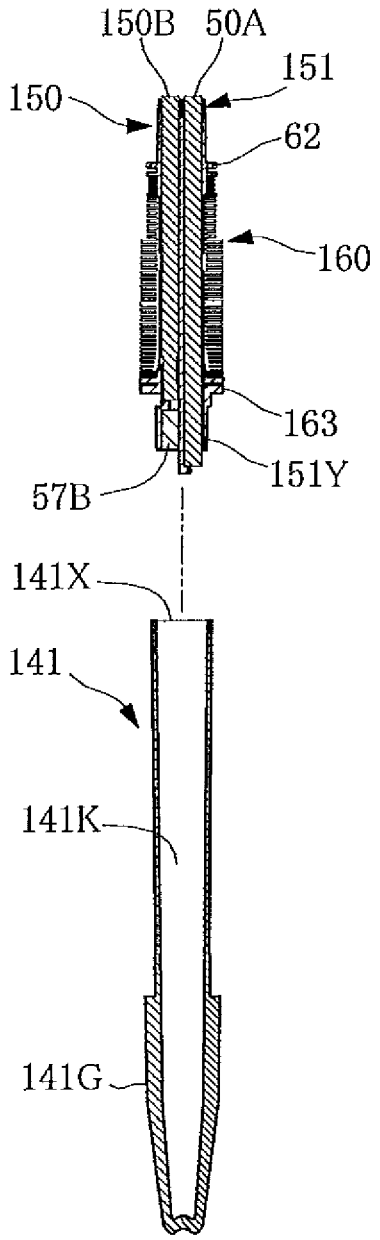
FIG. 16 is an exploded cross-sectional view illustrating an outline of a small container, a second ink induction mechanism and a second regulator mechanism that constitute the second writing instrument.

As illustrated in FIGS. 15 and 16, the ink induction mechanism 150 includes the first induction core 50A that induces the first ink to the pen tip mechanism 20, a second induction core 150B that induces the second ink to the pen tip mechanism 20, and an induction-core holding shaft 151 that holds the first induction core 50A and the second induction core 150B. A first through hole 151A that accommodates the first induction core 50A and a second through hole 151B that accommodates the second induction core 150B are formed in the induction-core holding shaft 151.

Figure 17:
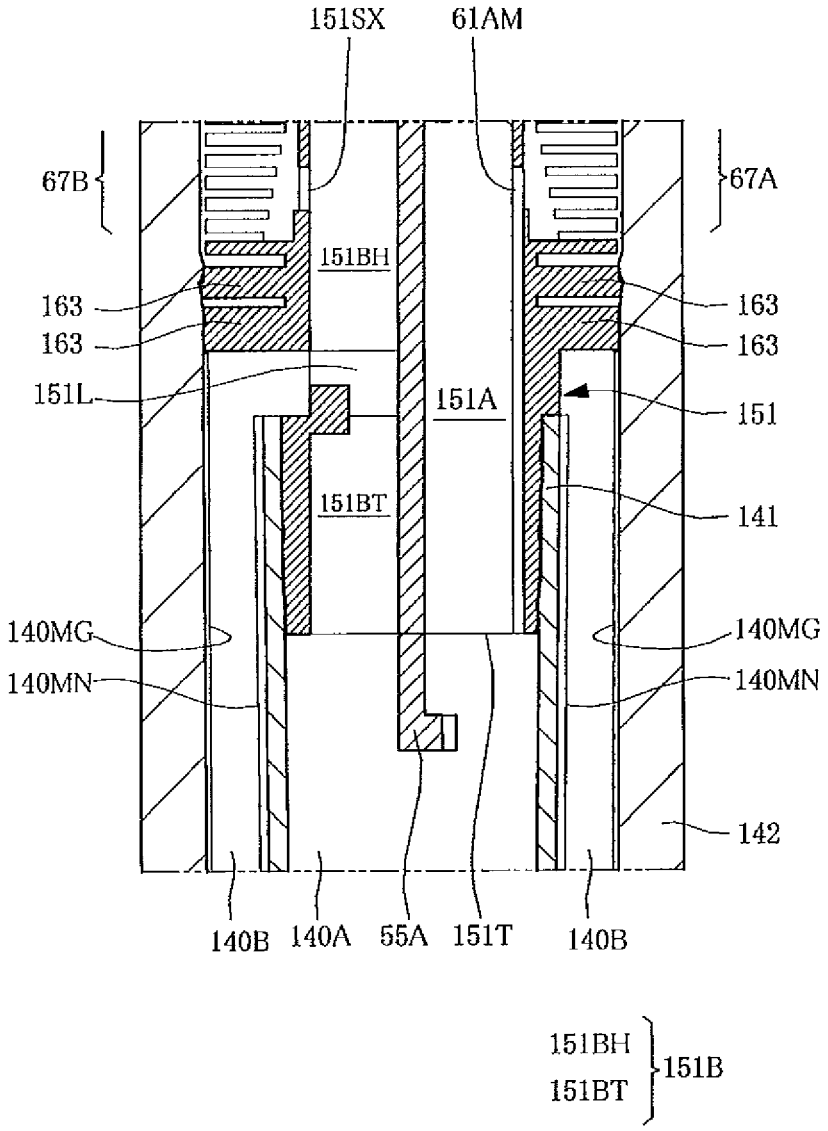
FIG. 17 is a cross-sectional view illustrating a state where a rear end part of a second induction-core holding shaft is fitted to a second ink tank mechanism.
Figure 18:
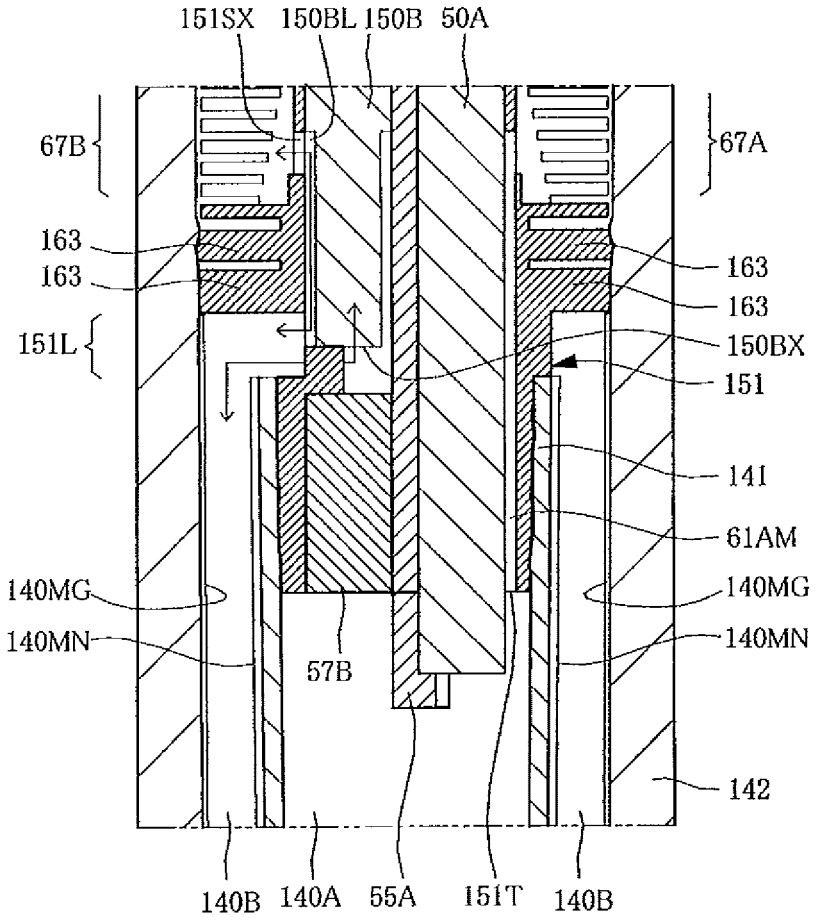
FIG. 18 is a cross-sectional view illustrating a state where the second ink tank mechanism is fitted to the second induction-core holding shaft in which the induction cores are accommodated.

As illustrated in FIG. 17, a cutoff part 151L that divides the second through hole 151B into a front hole 151BH and a rear hole 151BT is formed at a middle part of the induction-core holding shaft 151. As illustrated in FIG. 18, the first induction core 50A is inserted into the first through hole 151A. Further, the second induction core 150B is inserted into the front hole 151BH, and the clogging plug 57B is inserted into the rear hole 151BT. As a result, the second induction core 150B accommodated in the second through hole 151B is exposed to the cutoff part 151L. Since a rear end part 151Y of the ink induction mechanism 150, an opening 141X of the small container 141 and the clogging plug 57B are integrally formed to form an airtight structure, when the rear end part 151Y of the induction-core holding shaft 151 is inserted into the opening 141X of the small container 141, the rear end part of the first induction core 50A is released within the first ink tank 140A, and the first ink and the second ink are not mixed with each other in the ink tank mechanism 140 and the ink induction mechanism 150.

As illustrated in FIG. 14, by connecting a front end part of the induction-core holding shaft 151 to the pen tip mechanism 20, the front end of the first induction core 50A is pressed against the first pen tip 20A, and a front end of the second induction core 150B is pressed against the second pen tip 20B. With such a configuration, the first ink accommodated in the first ink tank 140A reaches the first pen tip 20A through the first induction core 50A, and the second ink accommodated in the second ink tank 140B reaches the second pen tip 20B through the second induction core 150B.

As illustrated in FIG. 16, the regulator mechanism 160 includes the flange structure 62 that protrudes from an outer peripheral surface of the induction-core holding shaft 151, a clogging unit 163 that is disposed at the induction-core holding shaft 151 located on the front side than the flange structure 62, the regulator flow path 67 (see FIG. 4) that is formed between the flange structure 62 and the clogging unit 163, the regulator brim 68 (see FIG. 4) that is disposed at the regulator flow path 67, a regulator partitioning plate 69 (see FIG. 4) that partitions the regulator flow path 67 into the first and second regulator flow path 67A and 67B.

Since an outer peripheral surface of the clogging unit 163 and an inner peripheral surface of the large container 142 are integrally formed to form an airtight structure, when the regulator mechanism 160 connected to the small container 141 is accommodated in the accommodation space 142K (see FIGS. 14 and 18), the second ink tank 140B and the second regulator flow path 67B are blocked from each other, and the second ink tank 140B and the first regulator flow path 67A are blocked from each other due to the clogging unit 163. For this reason, the first ink tank 140A and the first regulator flow path 67A are connected through the ink induction mechanism 50, and the second ink tank 140B and the second regulator flow path 67B are connected through the second induction core 150B. Since the cutoff part 151L is formed in the induction-core holding shaft 151, when the regulator mechanism 160 connected to the small container 141 is accommodated in the accommodation space 142K, the second ink can be circulated between a rear end surface 150BX of the second induction core 150B accommodated in the second through hole 151B and the second ink tank 140A through the cutoff part 151L.

As illustrated in FIGS. 17 and 18, a side hole 151SX that is communicatively connected to the front hole 151BH is formed in a side surface of the induction-core holding shaft 151 located on the front side than the cutoff part 151L, and a core cutoff part 150BL is formed in an outer peripheral surface of the second induction core 150B. The core cutoff part 150BL extends to a rear end from a middle direction. The core cutoff part 150BL may be uniformly formed on an outer peripheral surface, or may be linearly formed in a line in the back and forth direction. Thus, when the second induction core 150B is inserted into the second induction core 150B, the core cutoff part 150BL formed in the second induction core 150B functions as a vent hole that communicatively connect the side hole 151SX and the cutoff part 51L. With such a configuration, the second ink tank 140B is communicatively connected to the second regulator flow path 67B through the core cutoff part 150BL and the side hole 151SX.

As an ink guide mechanism for allowing ink to easily flow, an ink guide protrusion or an ink guide groove may be formed on an inner wall surface of the ink tank. Preferably, the ink guide mechanism extends in a direction in which ink is desired to flow, that is, the back and forth direction. In order to maximally widen a flow path width of the ink within the ink tank, the ink guide groove is preferably used as the ink guide mechanism. As such an ink guide groove, there are an ink guide groove 140MN formed on an outer peripheral surface of the small container 141, and an ink guide groove 140MG formed on an inner peripheral surface of the large container 142, for example. The ink guide groove 140MN and the ink guide groove 140MG are formed to face each other. The ink guide groove 140MN and the ink guide groove 140MG are preferably plural in number (for example, four pairs). The ink guide mechanism is applicable to the writing instrument 2 (see FIG. 1).

Figure 19:
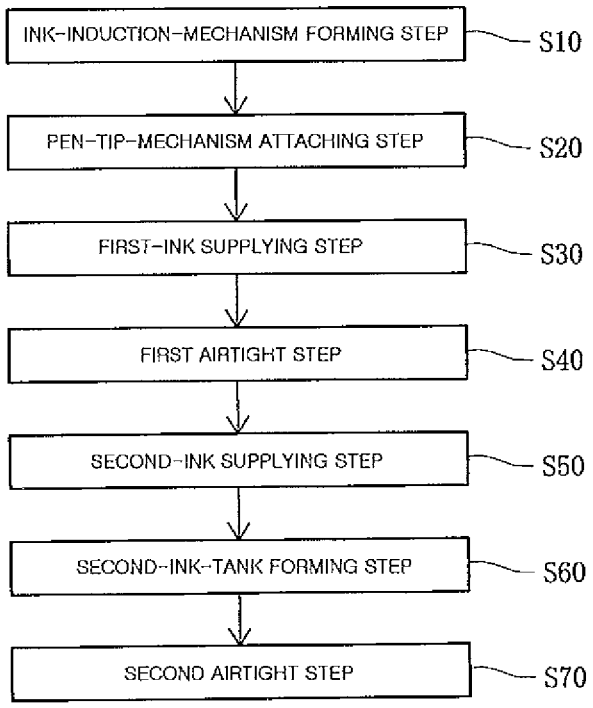
FIG. 19 is a flowchart illustrating an outline of a method of manufacturing the second writing instrument.

Next, a method of manufacturing the writing instrument 102 will be described with reference to FIG. 19. In the method of manufacturing the writing instrument 102, an ink-induction-mechanism forming step S10, a pen-tip-mechanism attaching step S20, a first-ink supplying step S30, a first airtight step S40, a second-ink supplying step S50, a second-ink-tank forming step S60, and a second airtight step S70 are sequentially performed.

In the ink-induction-mechanism forming step S10, the first induction core 50A, the second induction core 50B and the clogging plug 57B are respectively inserted into the first through hole 51A, the front hole 51BH and the rear hole 51BT to determine the positions thereof. By doing this, the ink induction mechanism 150 (see FIG. 16) is formed.

In the pen-tip-mechanism attaching step S20, the pen tip mechanism 20 is attached to the front end part of the ink induction mechanism 150.

In the first-ink supplying step S30, the first ink accommodating space 141K of the small container 141 is filled with a predetermined amount of first ink.

In the first airtight step S40, the rear end part of the ink induction mechanism 150 where the regulator mechanism 160 is formed is inserted into the opening 141X of the small container 141 such that the rear end part 151Y of the induction-core holding shaft 151 and the opening 141X of the small container 141 form an airtight structure (see FIG. 15).

In the second-ink supplying step S50, a predetermined amount of second ink is supplied from the opening 142X to the accommodation space 142KB (see FIG. 15) of the large container 142.

In the second-ink-tank forming step S60, the second ink tank 140B is formed between the large container 142 and the small container 141. Further, in the second-ink-tank forming step S60, the small container 141 and the respective components integrally formed with the small container 141 are inserted into the accommodation space 142KB that accommodates the second ink from the opening 142X such that the second ink tank 140B is formed (see FIG. 15).

In the second airtight step S70, an airtight structure is formed by the outer peripheral surface of the clogging unit 163 and the inner peripheral surface of the large container 142. Further, in the second airtight step S70, the small container 141 and the respective components integrally formed with the small container 141 are inserted into the accommodation space 142KB until the airtight structure is formed by the outer peripheral surface of the clogging unit 163 and the inner peripheral surface of the large container 142.

The first-ink supplying step S30 may be performed between the steps S50 and S60. Similarly, the first airtight step S40 may be performed at any step as long as the first airtight step is performed after the first-ink supplying step S30. In order to reliably prevent the first and second inks from being mixed, the first-ink supplying step S30 and the first airtight step S40 are preferably performed before the second-ink supplying step S50.

In a typical process of manufacturing a writing instrument, after an ink tank is previously formed is filled with ink, the ink tank is sealed. However, in the process of manufacturing the writing instrument 102, since the second ink tank is filled with the second ink before the second ink tank is formed, it is easy to fill the second ink tank with the second ink.

Since the ink tank mechanism 140 has a nested structure by the small container 141 and the large container 142, such a procedure is possible. Accordingly, it is easy to fill the second ink tank with the second ink in the writing instrument 102, as compared to the writing instrument 2.

Figure 20:
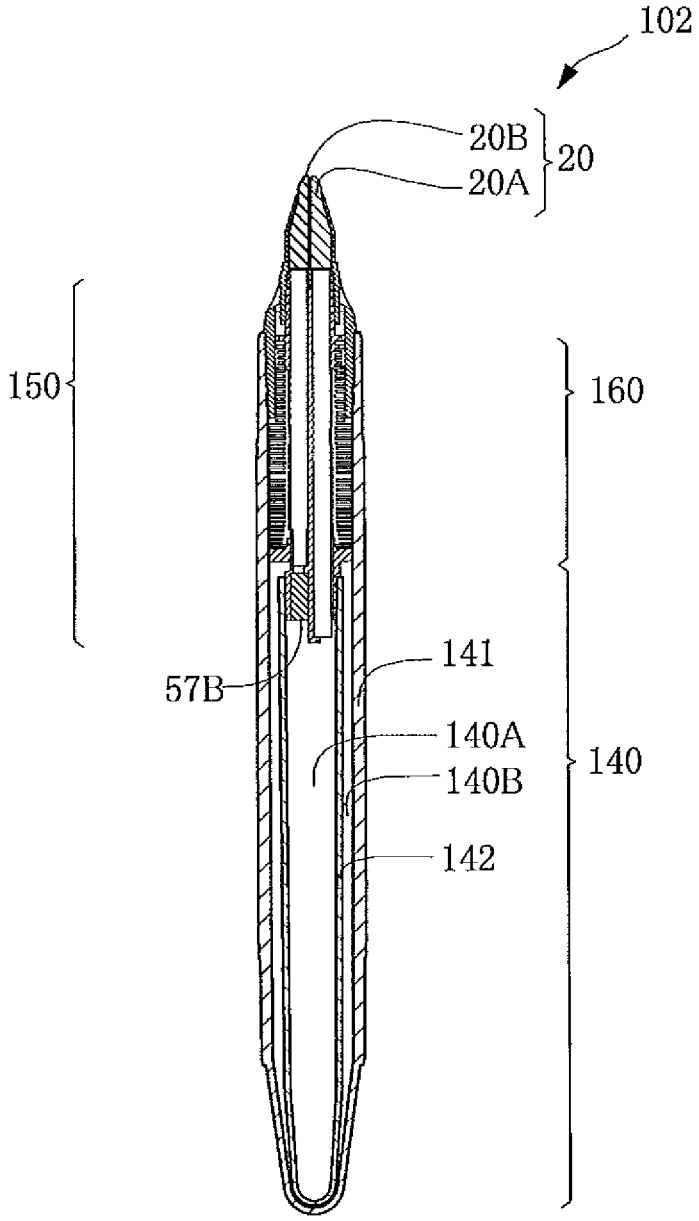
FIG. 20 is a cross-sectional view illustrating an outline of a third writing instrument.

Preferably, an outer peripheral surface 141G of the rear end part of the small container 141 has a shape capable of engaging with an inner peripheral surface 142N of the rear end part of the large container 142. Accordingly, a writing instrument illustrated in FIG. 20 may be used as the writing instrument 102.

As illustrated in FIG. 14, a bottom part 140AB of the first ink tank 140A is preferably located on a rear side than a bottom part 140BB of the second ink tank 140B. Thus, in the writing instrument 102 after being assembled, even when the second ink tank 140B is filled with the second ink, the first ink accommodated in the first ink tank 140A can be seen from the outside.

Preferably, the rear end part of the small container 141 engages with the rear end part of the accommodation space 142KB. That is, the outer peripheral surface of the rear end part of the small container 141 preferably has a shape capable of engaging with the inner peripheral surface of the rear end part of the large container 142. Thus, it is difficult for the second ink to stay between the small container 141 and the accommodation space 142KB. As a result, the writing instrument 102 can have a good external appearance.

Figure 21:
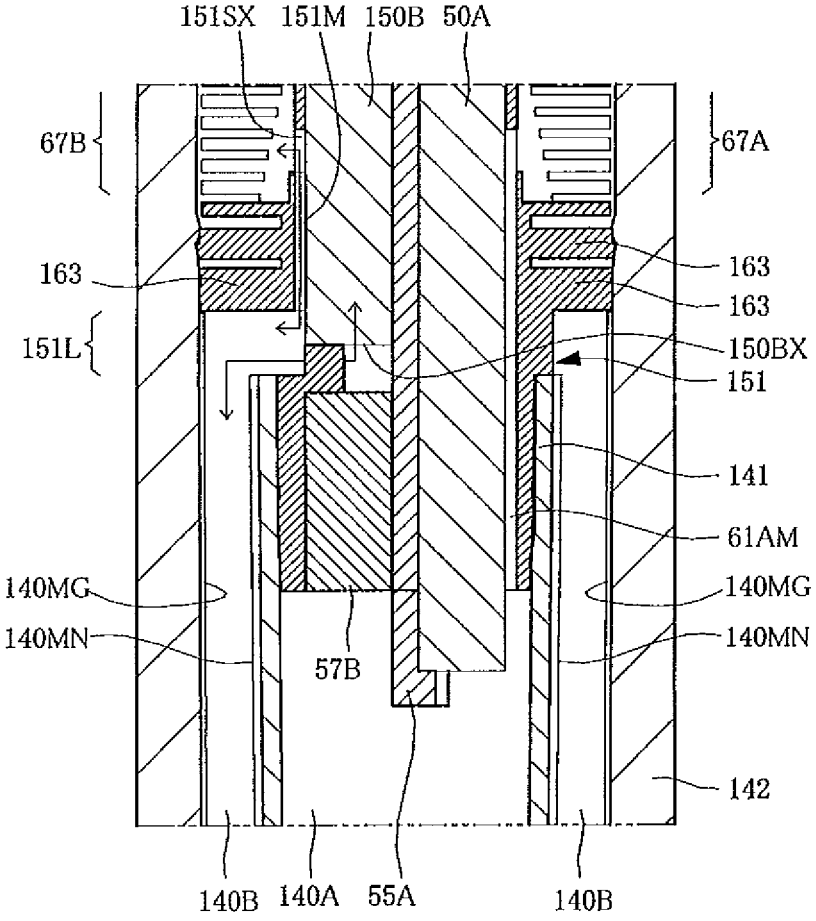
FIG. 21 is a cross-sectional view which enlarges a part of a third ink induction mechanism that is fitted to a third ink tank mechanism.

In the writing instrument 102, in order to communicatively connect the second regulator flow path 67B and the second ink tank 140B, the core cutoff part 150BL is formed in the outer peripheral surface of the rear end part of the second induction core 150B. However, the present invention is not limited to the aforementioned example, and a vent hole 151M (see FIG. 21) that communicatively connect the side hole 151SX and the cutoff part 1511 may be formed in the inner peripheral surface of the front hole 151BH.

In the above-mentioned embodiments, the latching protrusion 55A (see FIGS. 3 and 18) engaging with the rear end part of the first induction core 50A is formed on the rear end shaft surface 51T or 151T. However, instead of the latching protrusion 55A, a latching ring having a push hole into which the rear end part of the first induction core 50A is pushed the rear end part of the first induction core 50A may be formed within the first through hole 51A.

Figure 22:
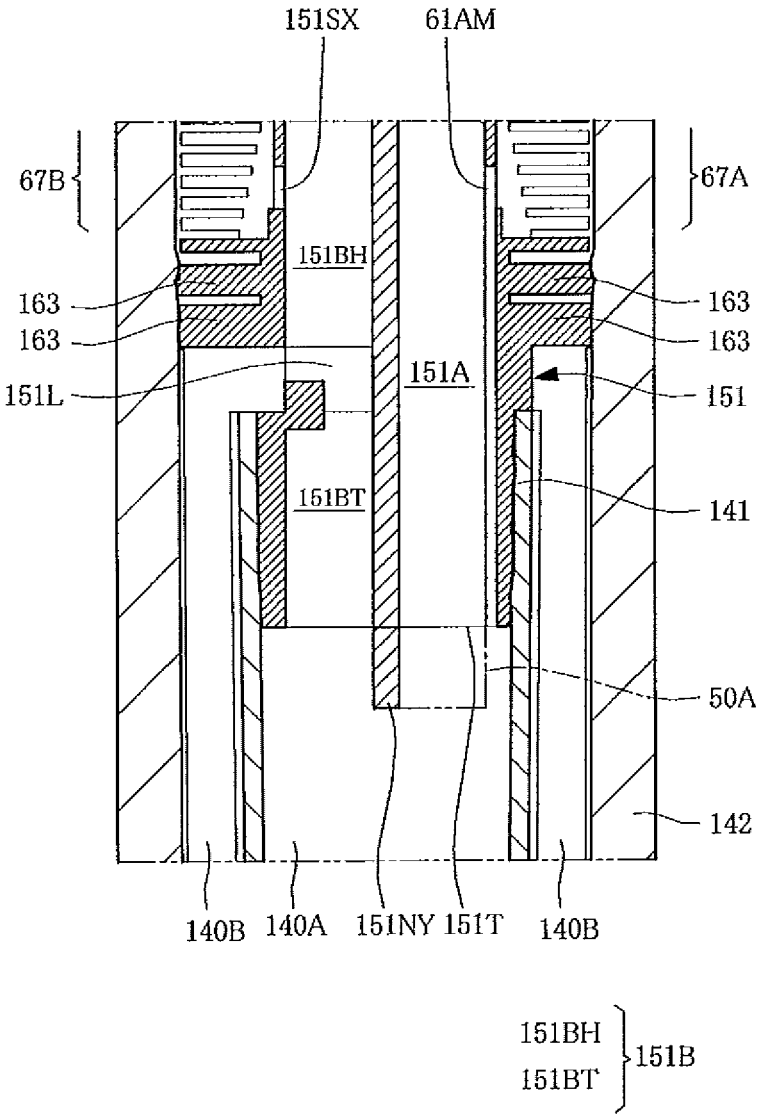
FIG. 22 is a cross-sectional view illustrating a modification example of the third ink induction mechanism.

As illustrated in FIG. 22, instead of the latching protrusion 55A, a first-induction-core fusing part 151NY to which the rear end part of the first induction core 50A is fused may be formed at the induction-core holding shaft 151. The first-induction-core fusing part 151NY protrudes toward the rear side from the rear end shaft surface 151T. An operation of fusing the rear end part of the first induction core 50A and the first-induction-core fusing part 151NY may be performed when the position of the first induction core 50A is determined. By forming the first-induction-core fusing part 151NY, it is possible to reduce an effort to form the latching protrusion 55A in the process of manufacturing the first-induction-core fusing part 151NY. The formation of the first-induction-core fusing part is not limited to a writing instrument holding two inks, such as the writing instrument 2 or the writing instrument 102, and is applicable to a writing instrument holding one ink.

Accordingly, the writing instrument includes an ink tank that accommodates ink, a pen tip mechanism that is disposed on a front end side and has a pen tip holding the ink discharged from the ink tank, an ink induction core that is provided at a circulation path of the ink connecting the ink tank and the pen tip mechanism and supplies the ink discharged from the ink tank to the pen tip, an induction-core accommodating body that accommodates the ink induction core, and a thermal fusing part that is fused to the ink induction core provided at the induction-core accommodating body.

Figure 23:
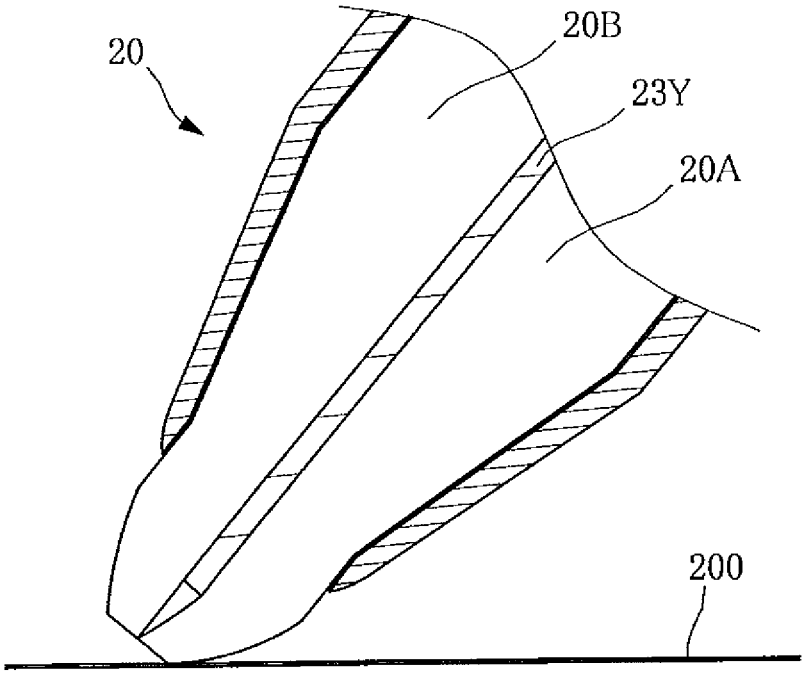
FIG. 23 is a cross-sectional view illustrating a state where an ink mixture of a first ink and a second ink adheres onto a paper surface by using a flexible pen tip.

The first pen tip 20A and the second pen tip 20B are preferably a flexible member. For example, when the first pen tip 20A is pressed against a paper surface 200, since the first pen tip 20A is bent (see FIG. 23), the second pen tip 20B comes in contact with the first pen tip 20A. As a result, since the second ink supplied from the second pen tip 20B is mixed with the first ink in the first pen tip 20A, an ink mixture of the first ink and the second ink is supplied from the first pen tip 20A. Accordingly, according to the writing instrument 2 or the writing instrument 102, the ink mixture can adhere onto the paper surface 200.

Figure 24:
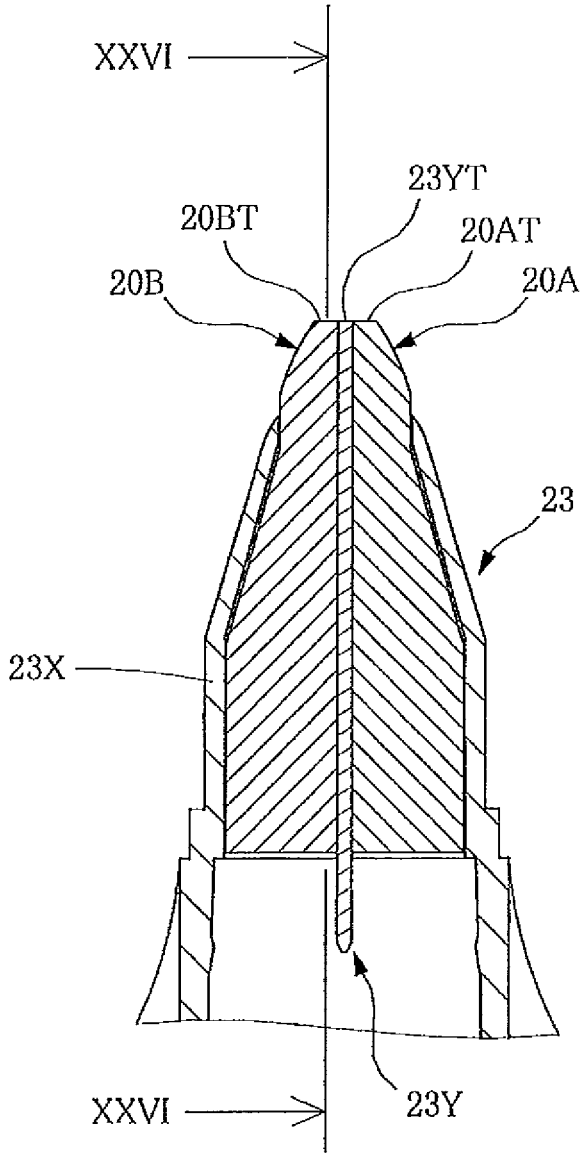
FIG. 24 is a cross-sectional view taken along line XXIV-XXIV illustrating an outline of a pen tip mechanism.
Figure 25:
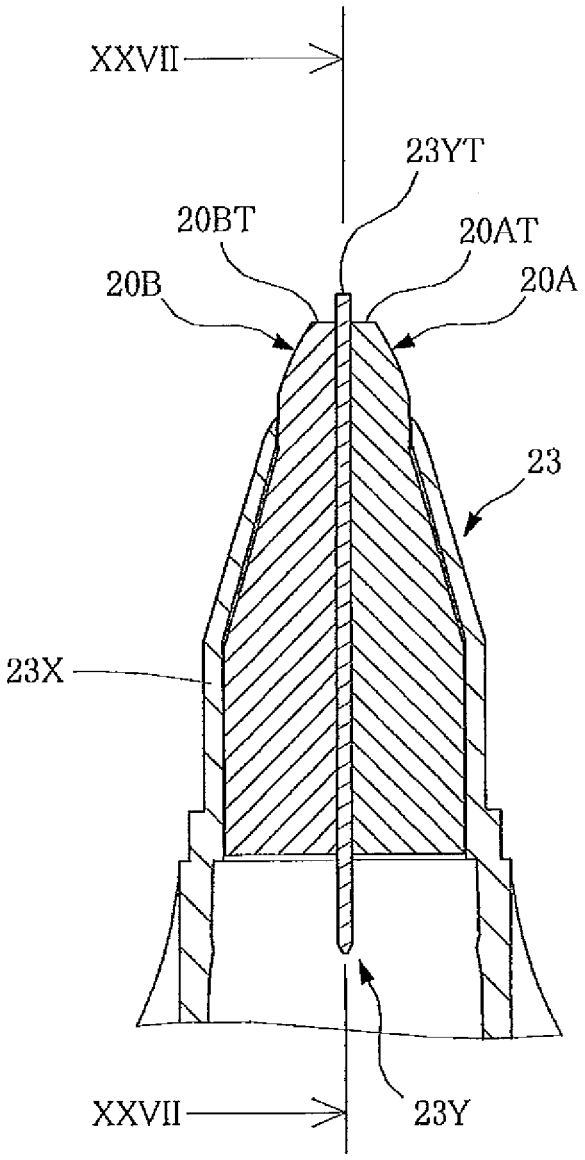
FIG. 25 is a cross-sectional view taken along line XXV-XXV illustrating the outline of the pen tip mechanism.

Although it has been described in the above-mentioned embodiment that the front end surface 23YT of the pen-tip partitioning plate 23Y is located on a rear side than the front end surface 20AT of the first pen tip 20A and the front end surface 20BT of the second pen tip 20B (see FIG. 9) (hereinafter, referred to as a front-end rear-side example), the present invention is not limited thereto. The front end surface 23YT may be flush with the front end surface 20AT and the front end surface 20BT (see FIG. 24) (hereinafter, referred to as a front-end flushing example). The front end surface 23YT may protrude toward the front side than the front end surface 20AT and the front end surface 20BT (see FIG. 25) (hereinafter, referred to as a front-end protruding example).

Figure 26:
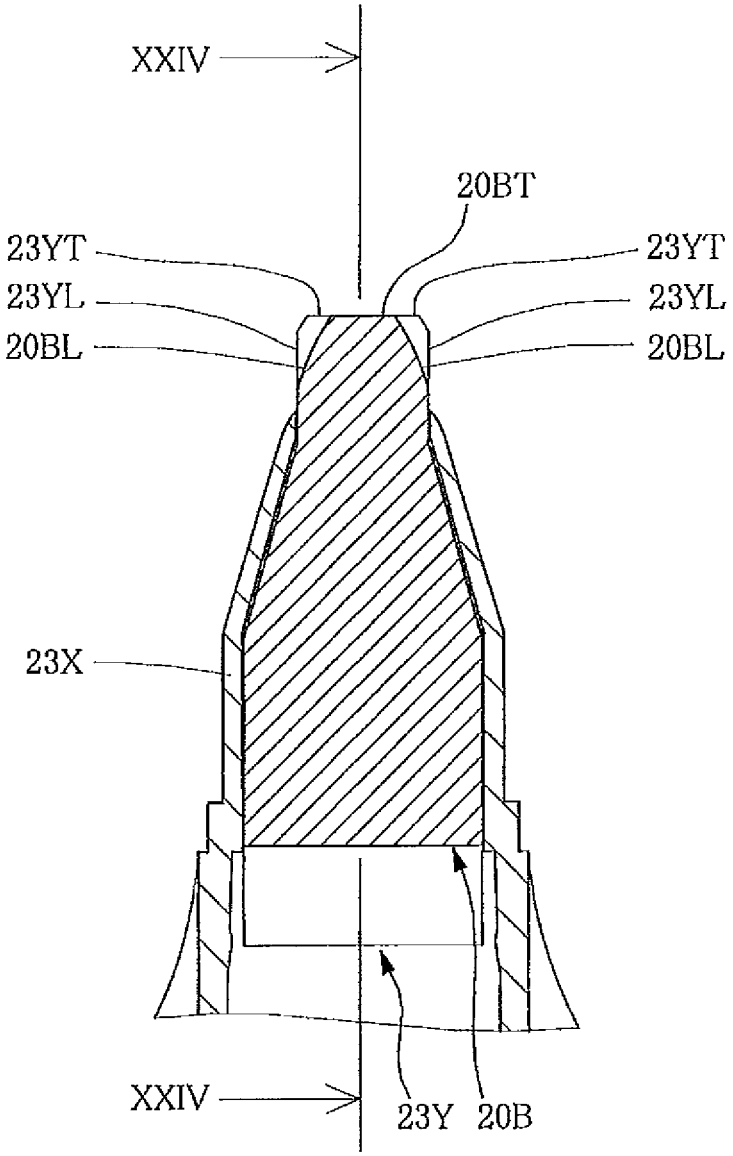
FIG. 26 is a cross-sectional view taken along line XXVI-XXVI illustrating the outline of the pen tip mechanism.

When the writing instrument corresponds to the front-end rear-side example (see FIG. 9) or the front-end flushing example (see FIG. 24), the front end of the pen tip mechanism 20 that is almost vertically erected is pressed against paper, so that the first pen tip 20A and the second pen tip 20B are simultaneously pressed against the paper. As a result, the first ink and the second ink simultaneously adhere onto the paper. Accordingly, it is possible to simultaneously perform writing of the first ink and writing of the second ink. Preferably, a side surface 23YL of the pen-tip partitioning plate 23Y protrudes outwardly in the diametric direction of the second pen tip 20B than a side surface 20BL of the second pen tip 20B (see FIG. 26) (hereinafter, referred to as a side-surface protruding example). Although not illustrated in FIG. 26, the side surface 23YL protrudes outwardly in the diametric direction of the first pen tip 20A than the side surface of the first pen tip 20A. Thus, when the front end of the pen tip mechanism 20 that is diagonally erected is pressed against the paper, writing of the first ink and writing of the second ink are prevent from being simultaneously performed, and any one of the writing of the first ink and the writing of the second ink can be performed.

Figure 27:
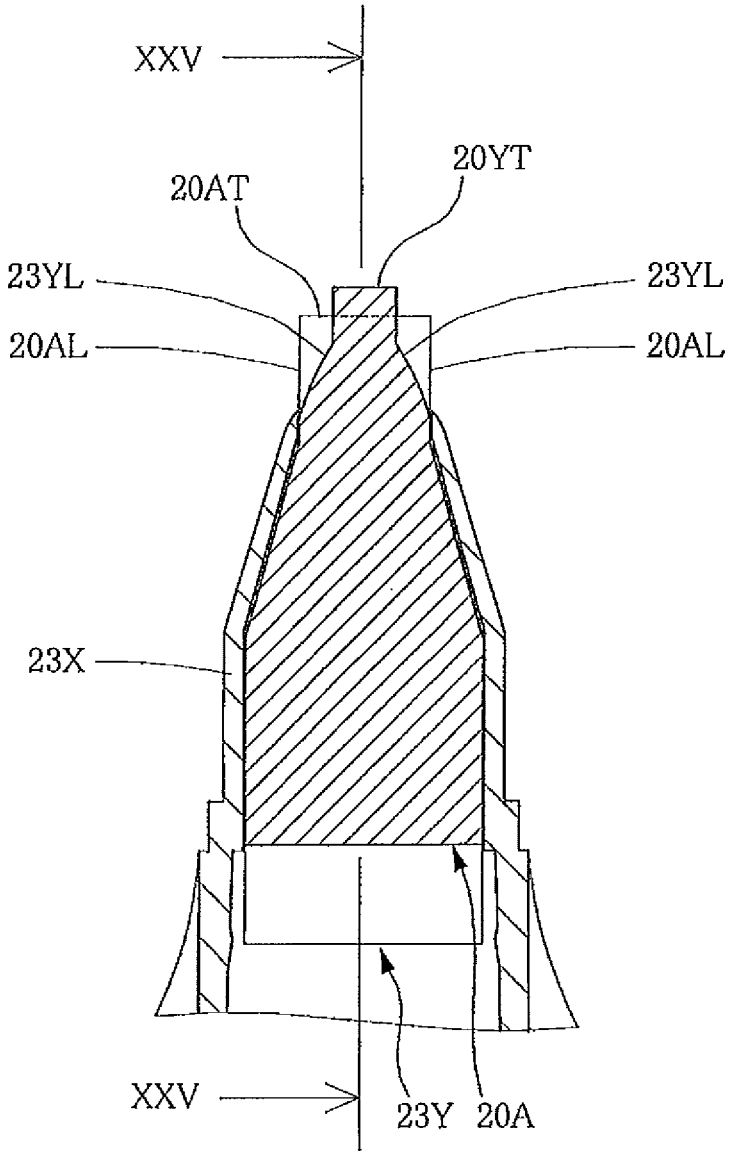
FIG. 27 is a cross-sectional view taken along line XXVII-XXVII illustrating the outline of the pen tip mechanism.

Meanwhile, if the writing instrument corresponds to the front-end protruding example (see FIG. 25), when the front end of the pen tip mechanism 20 that is almost vertically erected is pressed against the paper, the pen-tip partitioning plate 23Y comes in contact with the paper earlier than the first pen tip 20A and the second pen tip 20B. As a result, the first pen tip 20A and the second pen tip 20B are not simultaneously pressed against the paper. Accordingly, the writing of the first ink and the writing of the second ink are prevented from being simultaneously performed, and any one of the writing of the first ink and the writing of the second ink can be performed. Preferably, the side surface 23YL is retreated inwardly in the diametric diameter of the first pen tip 20A than a side surface 20AL of the first pen tip 20A (see FIG. 27) (hereinafter, referred to as a side-surface retreating example). Although not illustrated in FIG. 27, the side surface 23YL is retreated inwardly in the diametric diameter of the second pen tip 20B than the side surface of the second pen tip 20B. Thus, when the front end of the pen tip mechanism 20 that is diagonally erected is pressed against the paper, the writing of the first ink and the writing of the second ink can be simultaneously performed.

That is, a part where the pen-tip partitioning plate 23Y is retreated toward the inside or the rear side than the first pen tip 20A and the second pen tip 20B, and a part (protruding part) where the pen-tip partitioning plate 23Y protrudes toward the outside or the front side than the first pen tip 20A and the second pen tip 20B are preferably formed at the pen tip mechanism 20. The writing instrument 2 can switch writing between simultaneous writing of two types of inks and writing of one ink by changing a posture of the writing instrument.

The side surface 23YL may be flush with the side surface 20AL and the side surface 20BL. Accordingly, a part where the pen-tip partitioning plate 23Y is flush with the first pen tip 20A and the second pen tip 20B, and the protruding part may be formed at the pen tip mechanism 20.

The protruding part may be located on the front side than a part where the pen-tip partitioning plate 23Y is retreated toward the inside or the rear side than the first pen tip 20A and the second pen tip 20B or a part where the pen-tip partitioning plate 23Y is flush with the first pen tip 20A and the second pen tip 20B, or may be located on the rear side than the above part.

Figure 28:
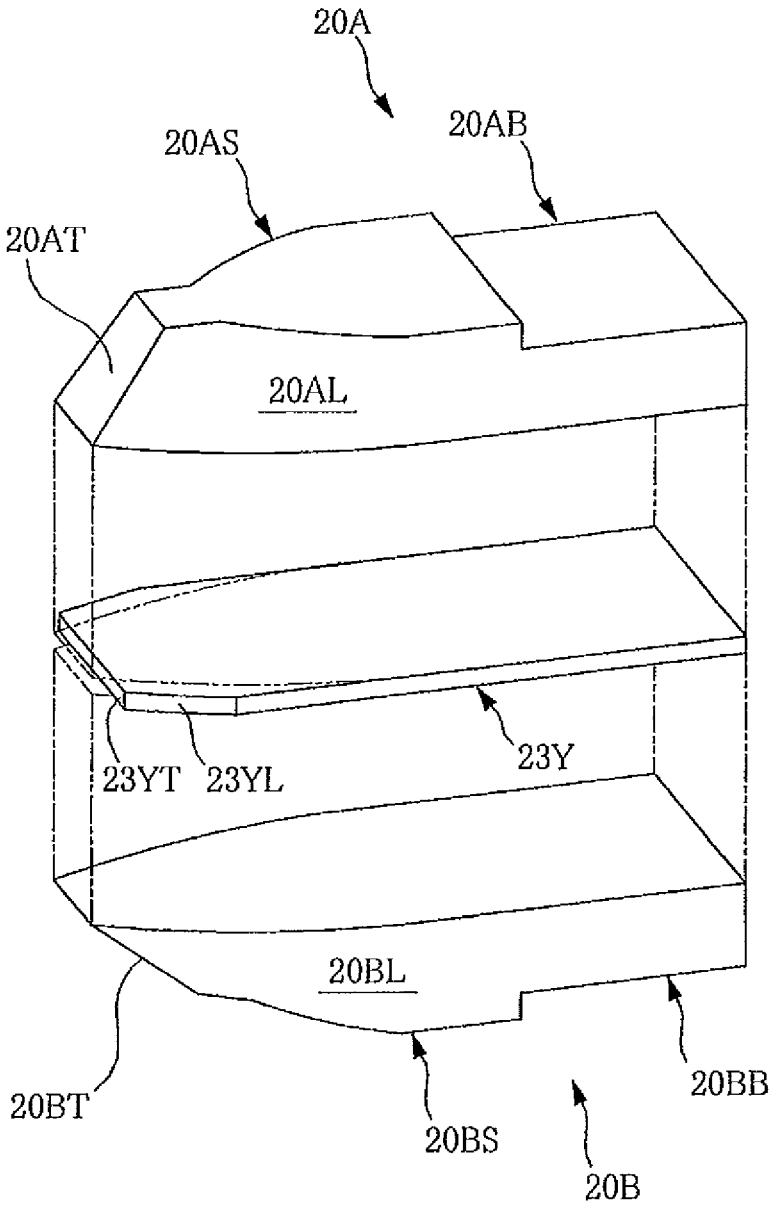
FIG. 28 is an exploded perspective view illustrating an outline of a pen tip mechanism of a front-end rear-side example and a side-surface protruding example.
Figure 29:
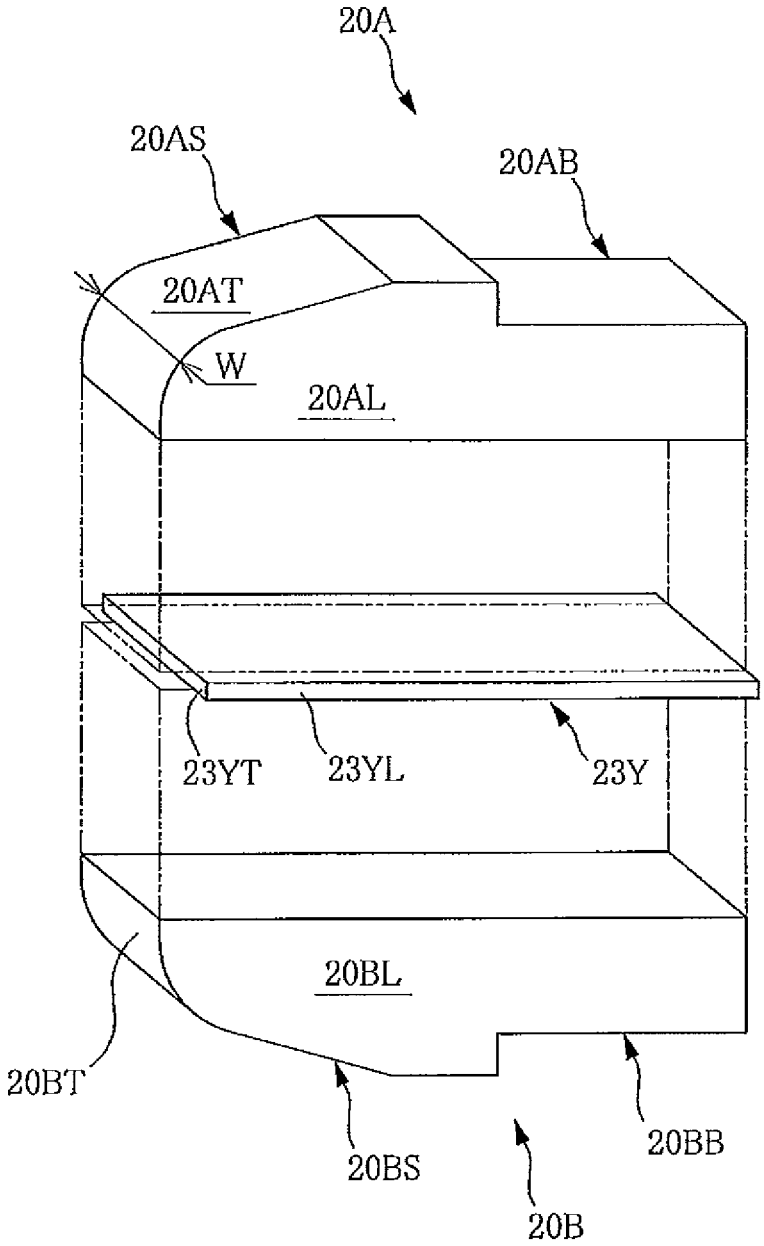
FIG. 29 is an exploded perspective view illustrating the outline of the pen tip mechanism of the front-end rear-side example and the side-surface protruding example.

At the first pen tip 20A and the second pen tip 20B illustrated in FIG. 9, since the base parts 20AB and 20BB have diameters greater than the front end parts 20AS and 20BS, that is, since the base parts 20AB and 20BB are formed to protrude from the front end parts 20AS and 20BS, the front end part 20AS of the first pen tip 20A is fitted from the rear side of the first pen holding hole 23A, and the front end part 20BS of the second pen tip 20B is fitted from the rear side of the second pen-tip holding hole 23B. Meanwhile, as illustrated in FIGS. 28 and 29, in the first pen tip 20A and the second pen tip 20B, the front end parts 20AS and 20BS may be formed to protrude from the base parts 20AB and 20BB. In such a case, the base part 20AB of the first pen tip 20A can be fitted from the front side of the first pen-tip holding hole 23A (see FIG. 9), and the base part 20BB of the second pen tip 20B can be fitted from the front side of the second pen-tip holding hole 23B (see FIG. 9). As a result, it is easy to perform an attachment operation or a replacement operation of the pen tips 20A and 20B.

In FIG. 9, the front end surfaces 20AT and 20BT are perpendicular to a longitudinal direction of the writing instrument 2 (see FIG. 1), but the present invention is not limited thereto. The front end surfaces 20A and 20BT may diagonally cross in the longitudinal direction of the writing instrument 2 (see FIG. 28).

In the writing instrument 2 of FIG. 9 or FIG. 28, since the front end surfaces 20AT and 20BT are formed in a planar shape, widths of lines drawn by the front end surfaces 20AT and 2013T are different depending on the posture of the writing instrument 2.

Here, in order to draw the lines having a regular width regardless of the posture of the writing instrument 2, the front end surfaces 20AT and 20BT are preferably bent to protrude toward the outside (see FIG. 29). Thus, it is possible to draw lines having a regular width W regardless of the posture of the writing instrument 2.

The writing instrument of the present invention is not limited to the aforementioned embodiments, and it should be appreciate that various modifications are possible without departing from the gist of the present invention.

The invention claimed is:

1. A regulator mechanism that is provided around a circulation path of ink which connects an ink tank to a pen tip holding the ink discharged from the ink tank to adjust a flow rate of the ink in the circulation path of the ink, the regulator mechanism comprising:

first and second regulator flow paths that are respectively set around circulation paths of first and second inks; and a flow-path partitioning member that is disposed to partition a regulator flow path into the first regulator flow path and the second regulator flow path, and prevents the first and second inks from being mixed with each other in the first and second regulator flow paths, wherein the first regulator flow path is a temporary accommodation space of the first ink and a space where air is circulated, and wherein the second regulator flow path is a temporary accommodation space of the second ink and a space where air is circulated.

2. The regulator mechanism according to claim 1, further comprising:

an ink induction mechanism that supplies the ink discharged from the ink tank to the pen tip, wherein the ink induction mechanism includes a first-circulation-path forming part that forms the circulation path of the first ink, and a second-circulation-path forming part that forms the circulation path of the second ink.

3. The regulator mechanism according to claim 2, wherein the first-circulation-path forming part includes a first-induction-core holding part that holds a first induction core which induces the ink discharged from the ink tank to the pen tip, the second-circulation-path forming part includes a second-induction-core holding part that holds a second induction core which induces the ink discharged from the ink tank to the pen tip, the first induction core functions as the circulation path of the first ink, and the second induction core functions as the circulation path of the second ink.

4. The regulator mechanism according to claim 3, wherein the first induction-core holding part includes a first induction-core accommodating hole which accommodates the first induction core, and the second induction-core holding part includes a second induction-core accommodating hole which accommodates the second induction core.

5. The regulator mechanism according to claim 4, wherein the ink induction mechanism includes a fist exposing opening that exposes a side surface of the first induction core inserted into the first induction-core accommodating hole to the first regulator flow path, and a second exposing opening that exposes a side surface of the second induction core inserted into the second induction-core accommodating hole to the second regulator flow path.

6. The regulator mechanism according to claim 4, wherein the first induction core is latched to the first induction-core holding part.

7. The regulator mechanism according to claim 3, wherein an end part of the first induction core opposite to the pen tip is located on a side opposite to the pen tip from the first induction-core holding part.

8. The regulator mechanism according to claim 3, wherein the first and second regulator flow paths are formed outside the first and second induction-core holding parts, and the flow-path partitioning member extends from an outside of the induction-core holding part to an inside of an ink induction housing to block the first regulator flow path from the second regulator flow path.

9. A writing instrument comprising:

the regulator mechanism according to claim 1;

the pen tip; and the ink tank.

10. A writing instrument comprising:

the regulator mechanism according to claim 3;

the pen tip; and the ink tank.

11. The writing instrument according to claim 10, wherein the ink induction mechanism includes a rear-end-surface opening space through which a rear end surface of the second induction core is opened, and the rear-end-surface opening space is communicatively connected to the ink tank.

12. The writing instrument according to claim 10, wherein the second induction core is communicatively connected to the ink tank through a side hole of the ink induction-core holding part.

13. The writing instrument according to claim 9, wherein the pen tip includes a first pen tip to which the first ink is supplied, a second pen tip to which the second ink is supplied, and a pen-tip holding mechanism that holds the first pen tip and the second pen tip to be parallel to each other, wherein the first induction core is connected to the first pen tip, and wherein the second induction core is connected to the second pen tip.

14. The writing instrument according to claim 13, wherein the pen-tip holding mechanism includes a first pen-tip holding mechanism that holds a base part of the first pen tip, a second pen-tip holding mechanism that holds a base part of the second pen tip, and a pen-tip partitioning mechanism that is disposed between a front end part of the first pen tip and a front end part of the second pen tip.

15. The writing instrument according to claim 14, wherein the pen-tip partitioning mechanism includes a flushing and retreating part that is flush with the first pen tip and the second pen tip or is retreated therefrom, and a protruding part that protrudes from the first pen tip and the second pen tip.

16. The writing instrument according to claim 15, wherein the flushing and retreating part is formed at a front part of the pen-tip partitioning mechanism.

17. The writing instrument according to claim 15, wherein the protruding part is formed at a side part of the pen-tip partitioning mechanism.

18. The writing instrument according claim 14, wherein any one of a front end of the first pen tip and a front end of the second pen tip is bent such that the first pen tip comes in contact with the second pen tip.

19. The writing instrument according to claim 9, wherein the ink tank includes a first ink tank that accommodates the first ink, and a second ink tank that accommodates the second ink.

20. The writing instrument according to claim 10, wherein the ink tank includes a first ink tank that accommodates the first ink, and a second ink tank that accommodates the second ink, wherein the first induction core is connected to the first ink tank, and wherein the second induction core is connected to the second ink tank.

21. The writing instrument according to claim 20, wherein a second ink communicating hole that communicatively connects the second ink tank and the second induction core is located close to the pen tip than a first ink-tank communicating hole that communicatively connects the first ink tank and the first induction core.

22. The writing instrument according to claim 19, wherein an end part of the second ink tank close to the circulation path of the ink protrudes toward the circulation path of the ink than an end part of the first ink tank close to the circulation path of the ink.

23. The writing instrument according to claim 19, wherein an end part of the first ink tank opposite to the pen tip is farther from the pen tip than an end part of the second ink tank opposite to the pen tip.

24. The writing instrument according to claim 19, wherein air is circulated between the second regulator flow path and the second ink tank through a second vent hole formed in the regulator mechanism without passing through the circulation path of the ink.

25. The writing instrument according to claim 19, wherein air is circulated between the second regulator flow path and the second ink tank through a second vent hole extending from the circulation path of the ink.

26. The writing instrument according to claim 19, wherein the ink tank has a double tube structure that includes a cylindrical large-diameter tube and a cylindrical small-diameter tube which has a diameter smaller than the large-diameter tube and is disposed inside the large-diameter tube, the first ink tank is formed inside the small-diameter tube, and the second ink tank is formed between the small-diameter tube and the large-diameter tube.

27. The writing instrument according to claim 26, wherein the small-diameter tube is coaxially disposed an inside of the large-diameter tube.

28. The writing instrument according to claim 26, wherein an end part of the circulation path of the ink close to the ink tank is positioned on an inside of the small-diameter tube.

29. The writing instrument according to claim 26, wherein the small-diameter tube and the large-diameter tube are formed to be separated from each other.

30. The writing instrument according to claim 26, wherein a tube connecting member that connects the small-diameter tube and the large-diameter tube.

31. The writing instrument according to claim 26, wherein a part of the circulation path of the ink where the small-diameter tube is positioned is communicatively connected to the first ink tank.

32. The writing instrument according to claim 26, wherein air is circulated between the first regulator flow path and the first ink tank through a first vent hole in a part of the circulation path of the ink where the small-diameter tube is positioned.

33. The writing instrument according to claim 26, wherein the ink tank includes an ink guide mechanism that guides the ink within the ink tank toward the circulation path of the ink, and the ink guide mechanism is any one of a small-diameter-tube outer groove that extends toward the circulation path of the ink formed on an outer peripheral surface of the small-diameter tube and a large-diameter-tube inner groove that extends toward the circulation path of the ink formed on an inner peripheral surface of the large-diameter tube.

34. The writing instrument according to claim 9, wherein the ink tank includes an ink guide mechanism that guides the ink within the ink tank toward the circulation path of the ink.

35. A method of manufacturing a writing instrument that includes a first ink tank accommodating a first ink, a second ink tank accommodating a second ink, a first pen tip to which the first ink accommodated in the first ink tank is supplied, and a second pen tip to which the second ink accommodated in the second ink tank is supplied, the method comprising:

a second-ink-tank forming step of forming the second ink tank between the first ink tank and an accommodation tool by using the accommodation tool in which the second ink is accommodated in an accommodation space and inserting the first ink tank into the accommodation tool.

36. The method of manufacturing a writing instrument according to claim 35, further comprising:

a second-ink supplying step of supplying the second ink to the accommodation space, the second-ink supplying step being performed before the second-ink-tank forming step.

37. The method of manufacturing a writing instrument according to claim 36, further comprising:

a first-ink supplying step of supplying the first ink to the first tank, the first-ink supplying step being performed before the second-ink supplying step.

38. The method of manufacturing a writing instrument according to claim 36, further comprising:

a first airtight step of sealing the first ink tank to which the first ink has been supplied, the first airtight step being performed before the second-ink supplying step.

39. The method of manufacturing a writing instrument according to claim 35, further comprising:

a second airtight step of sealing the second ink tank to which the second ink has been supplied.

* * * * *